US010982543B2

(12) United States Patent
Johnston

(10) Patent No.: US 10,982,543 B2
(45) Date of Patent: Apr. 20, 2021

(54) NEAR-ADIABATIC ENGINE

(71) Applicant: Barry W. Johnston, Baltimore, MD (US)

(72) Inventor: Barry W. Johnston, Baltimore, MD (US)

( * ) Notice: Subject to any disclaimer, the term of this patent is extended or adjusted under 35 U.S.C. 154(b) by 0 days.

(21) Appl. No.: 16/492,445

(22) PCT Filed: Mar. 10, 2017

(86) PCT No.: PCT/US2017/021900
§ 371 (c)(1),
(2) Date: Sep. 9, 2019

(87) PCT Pub. No.: WO2018/164696
PCT Pub. Date: Sep. 13, 2018

(65) Prior Publication Data
US 2020/0040731 A1 Feb. 6, 2020

(51) Int. Cl.

| | |
|---|---|
| ***F01B 29/10*** | (2006.01) |
| ***F01K 7/36*** | (2006.01) |
| ***F01K 25/04*** | (2006.01) |
| ***F01K 25/10*** | (2006.01) |
| *F04C 11/00* | (2006.01) |

(52) U.S. Cl.
CPC ..... *F01B 29/10* (2013.01); *F01K 7/36* (2013.01); *F01K 25/04* (2013.01); *F01K 25/10* (2013.01); *F01K 25/103* (2013.01); *F02G 2270/40* (2013.01); *F02G 2290/00* (2013.01); *F04C 11/008* (2013.01)

(58) Field of Classification Search
CPC ..... F01B 1/062; F01B 17/02; F01B 29/10; F01L 15/12; F01L 21/04; F01K 7/36; F01K 25/04; F01K 25/10; F02G 2270/40; F02G 2290/00; F04C 11/008
USPC ..... 60/659, 508–515, 516–526
See application file for complete search history.

(56) References Cited

U.S. PATENT DOCUMENTS 3,608,311 A * 9/1971 Roesel ..... F02G 1/0435 60/516
3,667,215 A * 6/1972 Rao ..... F02C 1/10 60/526

(Continued)

FOREIGN PATENT DOCUMENTS

WO 2016/134229 A1 8/2016

OTHER PUBLICATIONS

International Search Report and Written Opinion in PCT/US2017/021900, dated May 24, 2017, 27pp.

(Continued)

*Primary Examiner* — Mark A Laurenzi
*Assistant Examiner* — Mickey H France
(74) *Attorney, Agent, or Firm* — Hauptman Ham, LLP

(57) ABSTRACT

A near-adiabatic engine has four stages in a cycle: a means of near adiabatically expanding the working fluid during the downstroke (expansion stroke); a means of cooling the working fluid at Bottom Dead Center (BDC); a means of near adiabatically compressing that cooled fluid from the lower pressure/temperature level at BDC to the higher level at Top Dead Center (TDC); and finally, a means of passing that working fluid back into the high pressure/temperature source in a balanced condition with minimal resistance to that flow.

20 Claims, 14 Drawing Sheets

(56) References Cited

U.S. PATENT DOCUMENTS 3,767,325 A * 10/1973 Schuman ..... F02G 1/0435 417/207
5,562,079 A * 10/1996 Gray, Jr. ..... F02B 41/00 123/226
6,447,270 B1 9/2002 Schmidt et al.
6,474,058 B1 * 11/2002 Warren ..... F02C 5/00 60/39.6
8,156,739 B2 4/2012 Johnston
8,590,302 B2 * 11/2013 Risla Nes ..... F04B 19/00 60/521
2003/0196424 A1 * 10/2003 Warren ..... F02B 75/287 60/39.6
2005/0091974 A1 * 5/2005 Carnahan ..... F02G 1/0435 60/517
2006/0059906 A1 * 3/2006 Pierce ..... F02G 1/05 60/508
2006/0248886 A1 * 11/2006 Ma ..... F04B 25/00 60/517
2007/0220888 A1 * 9/2007 Komaki ..... F01K 13/006 60/645
2008/0121755 A1 * 5/2008 Bennett ..... B64D 27/023 244/59
2008/0276615 A1 * 11/2008 Bennett ..... F01L 3/20 60/614
2010/0186405 A1 * 7/2010 Conde ..... F02G 1/043 60/526
2010/0294224 A1 * 11/2010 Svensson ..... F02D 13/0215 123/179.16
2010/0326075 A1 * 12/2010 Fong ..... F01B 17/022 60/650
2011/0041506 A1 * 2/2011 Johnston ..... F01K 25/10 60/670
2011/0100738 A1 * 5/2011 Russo ..... B60K 6/24 180/65.245
2012/0042645 A1 * 2/2012 Katayama ..... F02G 1/05 60/525
2013/0174532 A1 * 7/2013 Kaiho ..... F02G 1/043 60/39.6
2013/0180243 A1 * 7/2013 Hurtado ..... F03G 7/04 60/641.6
2014/0007569 A1 * 1/2014 Gayton ..... F28D 7/024 60/508
2014/0230761 A1 * 8/2014 Pilavdzic ..... F01P 3/2271 123/41.21
2015/0300569 A1 10/2015 Baust et al.
2018/0238265 A1 * 8/2018 Johnston ..... F01K 25/10
2018/0371959 A1 * 12/2018 Ebert ..... F01K 3/12
2019/0218944 A1 * 7/2019 Dupont ..... F17C 7/04
2019/0234341 A1 * 8/2019 Maisotsenko ..... F02G 1/02
2020/0040731 A1 * 2/2020 Johnston ..... F01K 7/36

OTHER PUBLICATIONS

Extended European Search Report issued in corresponding European Application No. 17899317.6; dated Dec. 23, 2020; 6 pgs.

* cited by examiner

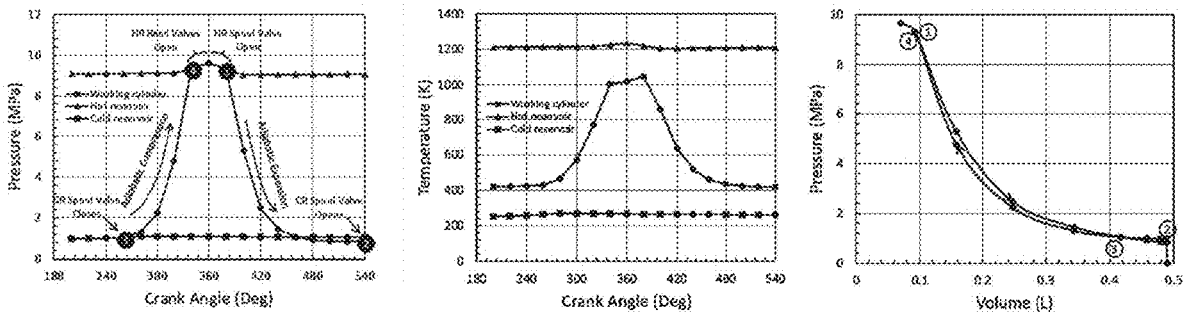
Graph 1: (a) (b) (c)
Property variations in reservoirs and working cylinder over the course of a single cycle
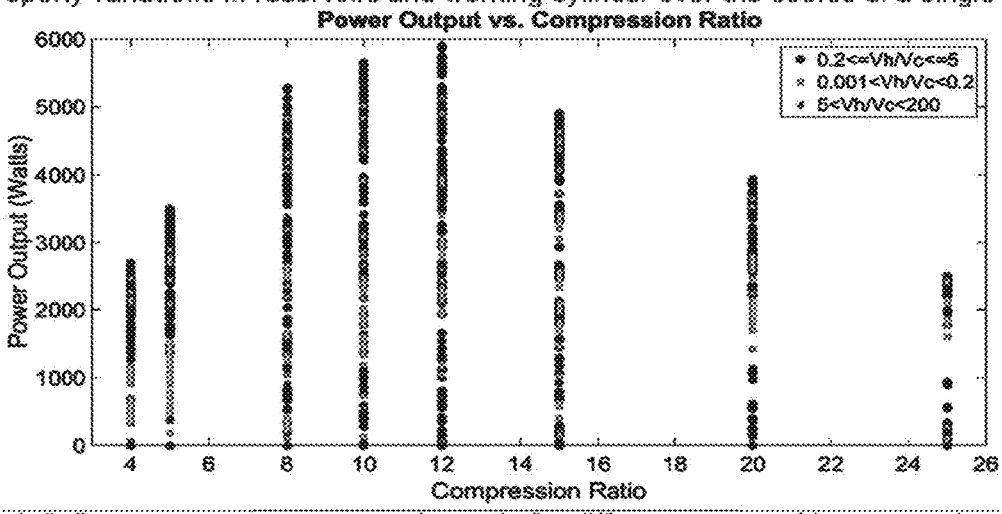
Graph 2: Power output vs. compression ratio for different ranges of hot reservoir to cold reservoir volume ratio. The working fluid is air and the speed is 1800 RPM.
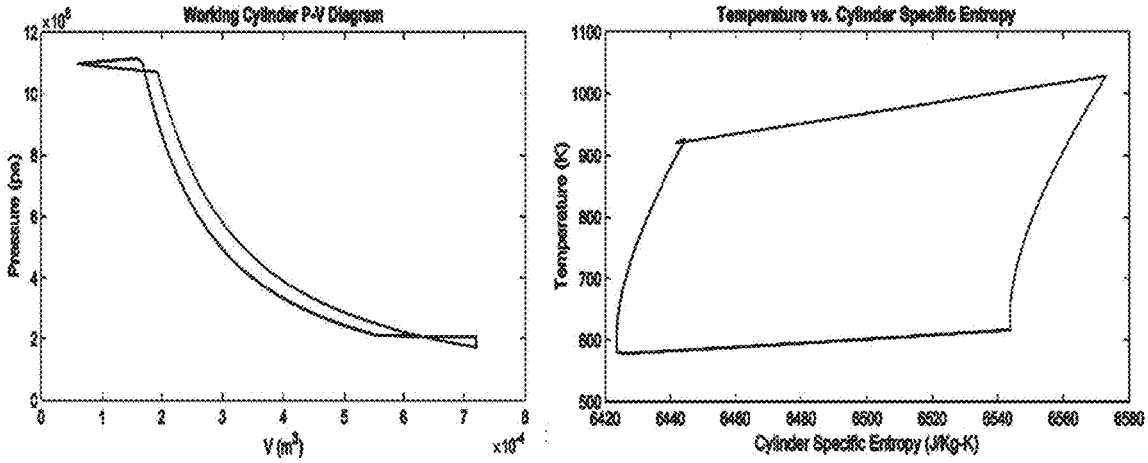
Graph 3: P-V and T-S Diagrams for the optimum power near-adiabatic cycle engine.
Figure 1

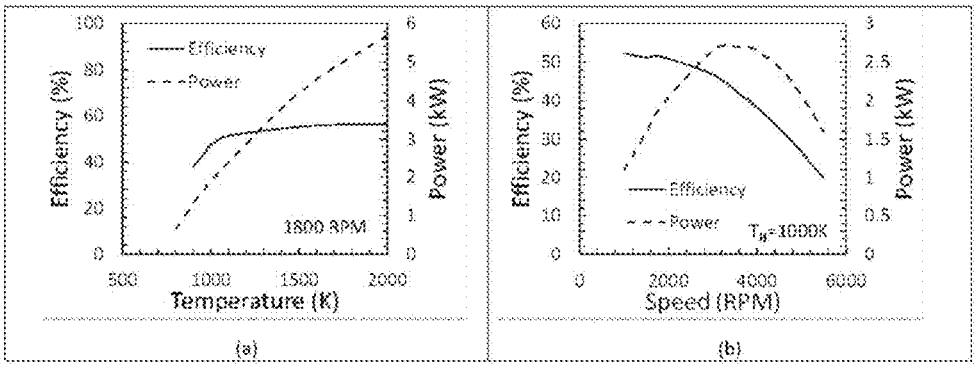

Graph 4: Effect of hot reservoir temperature (a) and operating speed (b) on the power output and efficiency of a near-adiabatic cycle engine optimized for efficiency. The working fluid is air, VH=VC=0.036m3, TC=300K and rC=15.

Table 1: Performance of near-adiabatic cycle engines optimized for power, efficiency, and BMEP at 1800 RPM, TH=1000K, VH=VC=0.036m3, rC=15 and with air as the working fluid.

| | Optimization Parameter | | | |
|---|---|---|---|---|
| Metric | Power | Efficiency | BMEP | |
| BMEP | 273 | 70.3 | 388.9 | kPa |
| Efficiency | 28.5 | 51.5 | 20.4 | % |
| Power | 5.9 | 1.9 | 3.5 | kW |

Table 2: Performance of some typical Stirling engines

| Engine | BMEP | Power | Fluid | $T_H$ | Speed | $P_{max}$ |
|---|---|---|---|---|---|---|
| SOLO | 2758 | 8-24 | He | 923 | 1500 | 15 |
| Sigma | 938 | 9 | He | - | 1600 | 8 |
| Uwe Moch | 131 | .5 | $N_2$ or Air | 923 | 600 | 1 |
| | (kPa) | (kW) | | (K) | (RPM) | (atm) |

Figure 2

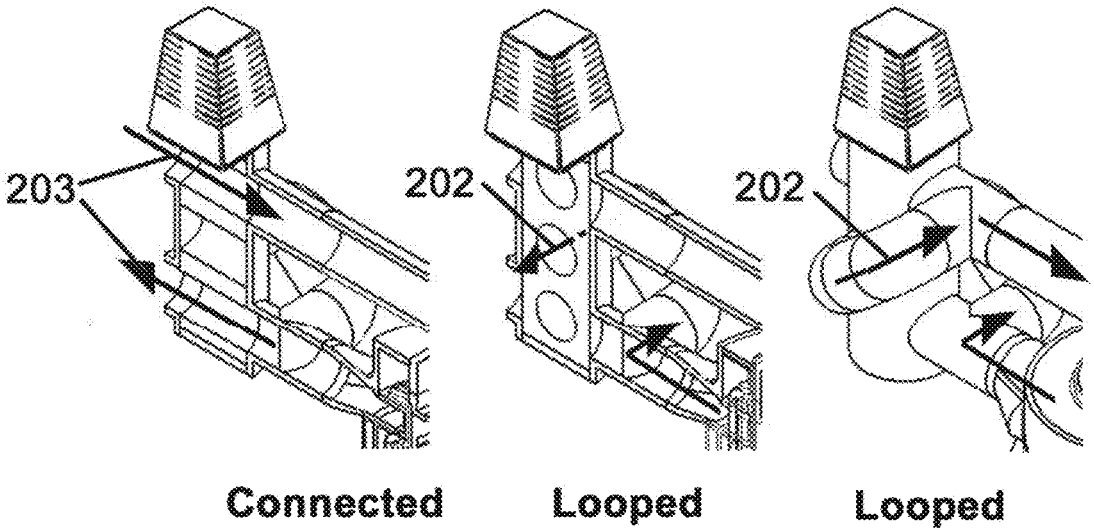
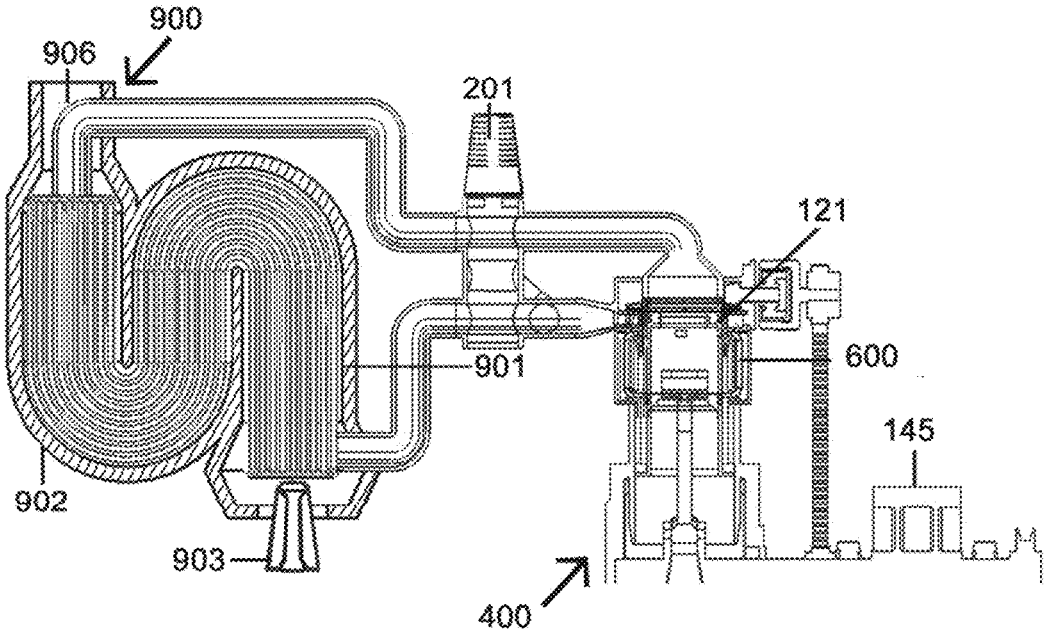
Figure 19

NEAR-ADIABATIC ENGINE

RELATED APPLICATIONS

The present application is a National Phase of International Application Number PCT/US2017/021900, filed Mar. 10, 2017, and is related to International Application No. PCT/US2009/031863 filed Jan. 23, 2009 which designates the United States and claims priority to U.S. Provisional Application No. 61/022,838 filed Jan. 23, 2008 and U.S. Provisional Application No. 61/090,033 filed Aug. 19, 2008, and Provisional Application No. 61/366,389 filed Jul. 21, 2010 and U.S. Pat. No. 8,156,739 issued Apr. 17, 2012. The present application is further related to U.S. Provisional Patent Application No. 62/118,519 filed Feb. 20, 2015. The entire disclosure of all of the above listed PCT and provisional applications is expressly incorporated by reference herein.

The entireties of related U.S. Pat. Nos. 4,698,973, 4,938,117, 4,947,731, 5,806,403, 6,505,538, U.S. Provisional Applications Nos. 60/506,141, 60/618,749, 60/807,299, 60/803,008, 60/868,209, and 60/960,427, and International Applications No. PCT/US2005/036180, PCT/US2005/036532 and PCT/US2016/018624 are also incorporated herein by reference.

BACKGROUND

The most efficient heat engines up to this disclosure, Stirling engines, invented 200 years ago, lose 30% efficiency because they expand and compress their internally cycling working fluid from the volumes incasing their heating exchanger and cooling reservoir, and hence their fluid is heated and cooled near-isothermally during the strokes so that some of the added heat cannot be fully converted to its full work output potential.

Ever since, thermodynamic specialists have sought ways to retrieve this balance. The Second Law states that heat always flows from a higher to a lower level. Some specialists have confused this quest to retrieve the balance by misinterpreting the Second Law of Thermodynamics to mean a fluid cannot be cycled from a low to a high energy level. In fact, to be near-adiabatic, a bolus of cycled working fluid must be cycled to a higher level before being reheated, batched back into the engine and expanded. This disclosed near-adiabatic engine does not pass its heat from a low to a high level, breaking the Second Law. Rather its working fluid is cycled from a lower pressure condition to a higher pressure condition in a balance of forces much like a boat passes through a canal lock. When raised, in this disclosure, the raised level is used to power the next downstroke (expansion stroke). But, after cycling, heat is added to that cycled fluid from an outside source.

Overall thermal efficiencies of typical four-stroke spark-ignited piston engines are in the ~20-30% range while four-stroke diesels achieve 30-40% range. The primary source of inefficiency in these engines is the loss of sensible enthalpy in the exhaust. This is less of a problem in closed cycle engines such as Stirlings where efficiencies of up to ~38% have been demonstrated in automotive applications. However, the performance of these engines suffers from the fact that a significant portion of heat is added during the power-stroke (expansion phase of the cycle) and during the recompression phase, thus increasing the entropy during the cycle. This effect is a direct consequence of how the displacer piston transfers fluid between the working cylinder and the hot and cold reservoirs. Hundreds of billions of dollars-worth of heat energy could be converted into electricity every year, if a cost-efficient heat-driven generator is developed. The Carnot principle indicates that a set amount of energy is available within a given temperature range that can be converted from heat to power if a way can be found to efficiently convert it.

SUMMARY

In one or more embodiments, this near-adiabatic heat engine comprises a working chamber, a power piston and a fluid pump volume. The power piston is moveable within the working chamber and the forces are united by the rotational inertia of a flywheel, running on working fluid in a high-pressure state receivable from a heating exchanger and cooled in the cooling reservoir. Six improvements are herein claimed:

1) A simplified pumping means wherein the diaphragm means of pumping (previously disclosed) is eliminated and replaced with the power piston means of pumping, the action occurring within the working cylinder. The working piston becomes both the power piston and the pump piston, both moveable within the working cylinder, wherein the quantity of the fluid in the expansion chamber, the quantity of fluid in the pump chamber and the quantity of fluid in the working chamber are determined by the positioning and sequential operation of the inlet valve between the hot heat exchanger and expansion chamber, and the connecting valve between the working chamber and the cooling reservoir, but the pumping cycle is driven by the action of the working piston.

2) Using a simplified valve means of opening the inlet valve from the hot heat exchanger, the inlet valve is mounted on the valve frame casing that is driven by the bevel gear train that is driven by the belt connection to the main drive shaft. The inlet valve herein is shown with five slits. The inlet valve opens five times with each rotation of the valve frame. The valve frame rotates six (6) times per second that means the valve opens 30 times a second or 1800 rpm. The inlet valve opens to fill the expansion chamber and shuts to allow the expansion chamber to expand near-adiabatically.

3) Using a simplified valve means of interconnecting the volumes between the engine working chamber and the cooling reservoir, the connection valve also is mounted on the valve frame casing and opens with the same number of sequences. That valve opens when the working piston is at Bottom Dead Center (BDC) and closes immediately before defining the pump volume during the upstroke. This connecting valve opens to allow pressurize working fluid in the cooling reservoir to be released when the working piston is at BDC and the valve stays open until the working fluid in the working chamber is recompressed into the cooling reservoir (and into the pump volume), and closes immediately before defining the pump volume so as to capture that recompressed working fluid in the cooling reservoir for the next cooling of the next expanded working fluid at the end of the next downstroke.

4) Using a means of disconnecting and reconnecting the flow between the hot heat reservoir and the engine itself, this valve is placed between the engine and the hot heat exchanger to prevent flooding of the engine with high pressure/temperature working fluid when the engine is not in operation. The valve caps off both access of the hot heat exchanger working fluid to the engine and it caps off the return of fluid from the engine. When the engine is stopped and is capping off the flow, flow is allowed to bypass the hot heat exchanger and be cycled directly back into the engine for easy startup. One embodiment would be to use an electronic zone valve.

5) Herein described is a means of rapidly cooling the working fluid in the cooling coils within the cooling reservoir by spraying a cold coolant on those cooling coils, creating rapid absorption of heat by creating a phase change within the cooling reservoir. The cooling coils are encased inside the cooling reservoir. A cold mist is sprayed out of multi opening directly onto the cooling coils, causing a phase change in the cooling reservoir that will rapidly absorb an immense quantity of heat. The coolant is fed into a liquid chamber and is sprayed to easily vaporize when in contact with the cooling coils. The fluid becomes a vapor and is forces with the rapid expansion out of the cooling reservoir where it again condenses into a liquid and is either recycled or used in other furnace room appliances as a booster as heat is needed.

6) Herein discloses is a means of snap-shutting the valve openings that are mounted on the valve frame to optimize flow through the inlet valve to the engine and to interconnect through a valve the fluid in the working chamber and the cooling reservoir within the engine. The inlet valve and connection valve described are designed to stay open until the point to snap shut. This delay in shutting and snapping shut optimizes the flow through the valves and thus the point of defining the expansion volume filled through the inlet valve and the point of defining the pump volume when the connection valve between the working chamber and cooling reservoir snaps shut. The large bevel gear swivels on the same axis as the valve frame casing that houses the inlet and connecting valves. The mechanism swivels only a couple of millimeters and is spring biased for rapid closing action at the point of closing to define the expansion volume and pump volumes.

Because this near-adiabatic engine has already used a flywheel as previously disclosed, the means for the cycling of the working fluid (previously using a diaphragm) was discovered to be redundant. Because the flywheel will even out the forces acting on the working piston occurring during the filling of the expansion volume and the emptying of the compression volume, in the same way the forces acting on the diaphragm were evened out within the balanced pressure environment surrounding said diaphragm, the dual actions essentially balance out as the forces filling the expansion chamber and emptying of the pump chamber during the cycle are nearly equal, as was taught by the issued patents. This simplification became apparent, when the engine was put into a running mode while operating in its virtual dynamic model. Thus, in fact, the diaphragm will be eliminated and replaced by the action of the working piston itself and alone. Said again, the filling of the expansion volume and the emptying of the pump volume are found to be connected, through their common connecting rod and driveshaft to the flywheel and their forces are essentially balanced out in the cycle, duplicating the forces that were before acting on the diaphragm as previously disclosed.

Regarding the working fluid, for this disclosure, air is used in this technical analysis. However, helium would be the working fluid for optimum heat to work conversion. Helium gas is suitable as an ideal working fluid because it is inert and very closely resembles a perfect gas, therefore providing the optimum heat to work conversion. Also, although volatile, hydrogen has been used. Its boiling point is close to absolute zero, improving its Carnot potential, but its atoms are small and may cause leakage problems. The greater the viscosity, the less leakage will occur. Other suitable media include, but are not limited to, hydrogen and carbon dioxide.

BRIEF DESCRIPTION OF THE DRAWINGS

The described embodiments are illustrated by way of example, and not by limitation, in the figures of the accompanying drawings, wherein elements having the same reference numeral designations represent like elements throughout, unless otherwise specified.

FIG. 1 provides backup analysis of the near-adiabatic cycle as described on page 9.

FIG. 2 provides backup performance analysis of the near-adiabatic engine as described on pages 9 and 10.

FIG. 19 shows a cross-sectional drawing of the relationship of the engine and the containment furnace, featuring a shutoff valve to prevent leakage from the containment furnace to the engine. Note the connection between the containment furnace and engine closes while the fluid internal to the engine is allowed to flow, making startup of the engine easier before adding heat.

DETAILED DESCRIPTION

Figure 3:
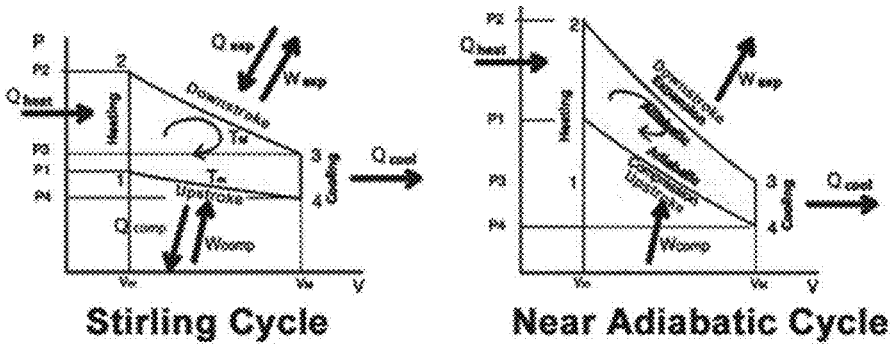
FIG. 3 compares Stirling engines with the disclosed near-adiabatic engine, explaining the reason the near-adiabatic cycle herein disclosed optimizes heat utilization and conversion into work output.

In the following detailed description, for purposes of explanation, numerous specific details are set forth in order to provide a thorough understanding of the specifically disclosed embodiments. It will be apparent, however, that one or more embodiments may be practiced without these specific details. In other instances, well-known structures and devices are schematically shown in order to simplify the drawing.

A near-adiabatic engine has four stages in a cycle: (1) a means of near-adiabatically expanding the working fluid during the downstroke (expansion stroke); (2) a means of cooling the working fluid at Bottom Dead Center (BDC); (3) a means of near-adiabatically compressing that cooled fluid from the lower pressure/temperature level at BDC to the higher level at Top Dead Center (TDC); and finally, (4) a means of passing that working fluid back into the high pressure/temperature source in a balanced condition with minimal resistance to that flow. This disclosure builds on lessons learned in stages (1), (2), (3), and (4) which were patented in U.S. Pat. No. 8,156,739 issued Apr. 17, 2012 and in PCT/US2016/018624, and include improvement regarding the operation of the valves, the cooling means for the cooling reservoir, and a shutoff between the hot heat exchanger and the engine when the engine stops. This disclosure describes a simplified means of cycling the working from pump volume to the hot heat exchanger and to inject the bolus from the hot heat exchanger into the expansion chamber before near-adiabatic expansion.

As to comparing the Stirling engine with the herein disclosed near-adiabatic engine, experts in thermodynamics have long known that the ideal cycle is "adiabatic," meaning that the stroke occurs without gain or loss of heat and without a change in entropy so that, during the process of expansion and recompression, all the energy within the given temperature bracket is given out as power or returned to the closed system. Such an adiabatic engine is sometimes referred to as a Carnot engine which receives heat at a high absolute temperature $T_1$ and gives it up at a lower absolute temperature $T_2$, with its optimum efficiency potential equaling $(T_1-T_2)/T_1$.

The first law of thermodynamics (law of conservation of energy) states that the change in the internal energy of a system is equal to the sum of the heat added to the system and the work done on it. In this disclosed near-adiabatic engine, the heat in and out is proportional equal to the work out and in, proportionally recognizing the Carnot limit of the temperature range. The second law of thermodynamics states that heat cannot be transferred from a colder to a hotter body within a system without net changes occurring in other bodies within that system; in any irreversible isothermal process, entropy always increases. In other words, in a perfect cycle, heat in and out is equal to work out and in, as stated above, but, of course within the Carnot limits. But Stirlings, operating at a constant high and a constant low, will experience an entropy increase and decrease.

However, an ideal adiabatic stroke is reversible. Thus, heat potential can be converted into work output, and work input can be converted back into heat potential, $\Delta Q=\Delta W$. Work output of the engine results from utilizing the higher heat capacity of the nearly adiabatic downstroke as compared to the lower heat capacity for the near-adiabatic upstroke, i.e., reversible expansion for work output is countered by anti-work input after the heat removal at BDC. The heat removal is bringing the pressure/temperature conditions in the working chamber at BDC down to an ideal sink level before recompression.

The innovation advances the efficiency beyond cutting-edge Stirling engines by 20%. Stirlings have nearly isothermal cycles, meaning they operate at a constant high and constant low temperature within their respective working chambers. In the disclosed near-adiabatic engine, the working fluid is pumped from the low to the high temperature/pressure levels. Thus, the working fluid is circulated, while, in Stirling engines, the working fluid is pressed back and forth within the common containment of the engine and heating exchanger and cooling reservoir. In circulating the fluid from a low to high level in a near-adiabatic engine, the disclosure shows the batching of the working fluid, shows that that batch is isolated and expanded in isolation, extracting the optimum energy out of that fluid and converting it into work output.

The herein disclosed near-adiabatic engine, a closed cycle engine, greatly reduces the heat loss by using a patented mechanism (consisting of a rotating valve acting in conjunction with the motion of the piston) to rapidly introduce hot working fluid into a conventional piston-cylinder with minimal pressure loss. Enough mechanical separation is present between the hot and cold reservoirs and the expansion/compression components that the expansion and compression processes occur nearly adiabatically. The net effect is that the disclosed process approximates more closely the near-adiabatic cycle than other engines, the idealized heat addition and expansion processes associated with the Carnot cycle. Thus, it is inherently more efficient.

How the Near-Adiabatic Engine Works

Of course, Spark Ignition engines are powered by the pulse of the controlled explosion in the working chamber and throw off their expended hot gases after that controlled SI explosion. The disclosed near-adiabatic engine, unlike Stirlings, is a closed system which is powered by the work differential between the positive work caused by the high temperature/pressure expansion downstroke (Points 1 to 2) and negative anti-work caused by the cooling/recompression upstroke (Points 3 to 4). With the disclosed engine, these cyclical expansion and recompression strokes occur nearly adiabatically within the same working cylinder, and are possible because two displacement volumes open and close during the cycle at Top Dead Center (TDC), Point 1 (the expansion volume opens after the pump volume has closed) and at Bottom Dead Center (BDC), Point 2 (the expanded volume is cooled before the upstroke). Remembering that adiabatic means all the energy within the given temperature bracket is given out as power or returned to the closed system, two conditions must be met to achieve an adiabatic cycle: 1) The working fluid must be cycled from its low to high heat/pressure source with low mechanical losses, solving "Maxwell's Demon" issue; and 2) The working strokes must expand and recompress in isolation, hence adiabatically. Cycling of the working fluid from the low to high pressure happens because the work caused by filling the expansion volume balances with the anti-work caused by emptying the pump volume which are directly connected and balanced by the unifying force of the flywheel. A critical feature of the cycle is the cooling of the working fluid at BDC. During the entire upstroke (Points 3 to 4), the expanded working fluid is internally completely squeezed out of the working chamber (which includes the expanded volume and pump volume) into the cooling reservoir and simultaneously compressed into the pump volume, and then out of the engine into the hot heat exchanger. All three volumes—the working chamber, the cooling reservoir, and the pump volume—share the same pressure condition. At TDC, the fluid is pressed (cycled) out of the engine into the hot heat exchanger before the next injection of an equal quantity of hot working fluid into the opening expansion chamber.

As previously disclosed, the expansion chamber and the working chamber fluidly communicate as one volumetric unit. As previously disclosed, the expansion volume is near-isothermally filled. That volume was also monitored by the point of closing the inlet valve between the hot heat exchanger and the expansion chamber. As previously disclosed, the remaining downstroke, or expansion stroke, the working fluid is near-adiabatically expanded until the working piston reaches near Bottom Dead Center (BDC) in which that working fluid (Stage 1) is nearly fully expanded. Consistent with the previous patent, after the expansion downstroke, a means was disclosed in the previous patent of cooling the expanded working fluid at BDC (Stage 2). As previously disclosed, the working chamber is controllably, fluidly communicable with the pump chamber during the compression upstroke of the power piston for near-adiabatically compressing the cooled working fluid from the low pressure state into the higher state into the pump chamber, volume (Stage 3), while, in the cooling reservoir, simultaneously near-isothermally compressing the balance of fluid back into the cooling reservoir, thus removing heat and containing that cooled fluid to be released at the bottom dead center position (BDC) of the next cycle. BDC cooling is achieved, as previously disclosed, by: a) a disclosed means of, during the previously compression upstroke, compressing a portion of the fluid that is in the working chamber into the cooling reservoir during the upstroke so that its fluid was near-isothermally cooled, b) a disclosed means of containing that fluid during the sequent downstroke, expansion stroke, and c) a disclosed means of releasing that fluid at BDC into the working chamber, supercooling the expanded working fluid before recompression. So, after BDC cooling, the disclosure also teaches a means of achieving near-adiabatic compression during the upstroke into the pump volume (stage 3) that will ensure that the same quantity of fluid that is pressed into the pump volume is an equal quantity of fluid as compared to the initial volume of the bolus that was initially injected at Top Dead Center (TDC) into the expansion chamber from the hot heat exchanger as described in previous patents.

The balance of forces in the pumping process is achieved by balancing the near equal work acting on the common piston due to the pressure in the expansion chamber and counter balanced by the pressure caused during the pumping process. The balance of forces is created by the unifying common rotational inertia of the flywheel itself acting on the working piston. The flywheel (as shown in previous patents) is now incorporated directly into the pumping action, allowing the transfer of cycled fluid to be pressed from the lower pressure state in the pump chamber back into the high-pressure state in the heating exchanger (stage 4), completing the cycle.

In summary, this disclosure teaches this above format and teaches a means of an improved the inlet valve and the connecting valve, teaches a means of isolating the engine cycling process from the hot heat exchanger during start up for easier startup turnover, teaches a means of efficiently cooling in the fluid in the cooling reservoir by spraying a coolant fluid mist, such as cool water or ammonia/water, over the cooling coils to optimize the heat removal by creating an optimum phase change condition in the cooling fluid thus optimally the removal of heat, and teaches a means of snap closing the inlet valve and connection valve of the valving mechanism. This disclosure also recognizes that the valving means can be electronically actuated.

Why the Engine is Near-Adiabatic

Reason 1—As taught in previous patents, the expansion chamber is filled and expansion downstroke is near-adiabatically expanded because the working fluid 703 is isolated before that expansion (Stage 1).

Reason 2—At BDC, the appropriate amount of heat used during the downstroke work output is removed by injecting the cold fluid from the cooling reservoir 600 (Stage 2). Actually, the appropriate heat removal amount must be sufficient to achieve the near-adiabatic upstroke within the temperature high to low range. In the previous upstroke, heat in the cooling reservoir 600 was near-isothermally removed by the previous compression of that fluid into the cooling reservoir 600 during the previous upstroke (from Point 3 to 4, Stage 3). And the balance was near-adiabatically compressed into the pump chamber 701 for recycling. During the next downstroke from TDC to BDC, this retained, compressed, cooled fluid in the cooling reservoir 600 is released into the working chamber 104 at BDC, supercooling the expanded working fluid 703, bringing the mean temperature/pressure down to the ideal low temperature/pressure level (Stage 2). Thus, after being accessed to the working chamber 104, the BDC temperature and pressure approach the ideal Carnot bracket level.

Reason 3—The pre-access BDC and post-pressurized TDC conditions within the cooling reservoir 600 are the same. When determining the p-V work input $\Delta W=\Delta F\Delta d$, the upstroke length $\Delta d$ (from points 3 to 4, Stage 3) is the same. In the temperature bracket of 922° K to 294° K range, the temperature in the cooling reservoir 600 remains a near constant 294° K with its density rising to 1.9094 times the density in the high energy pump, balancing the pressure buildup ($\Delta p$) in the pump, matching the progressive buildup of force ($\Delta F$) required to achieve an ideal adiabatic upstroke.

Reason 4—At TDC, the working fluid 703 passes back from the pump volume into the hot/high pressure heat exchanger 500 balancing the force (work) against the force (work) caused during the filling of that working fluid into the expansion chamber. The balance of forces is caused by the rotational inertia of the flywheel acting on the common piston.

The Near-Adiabatic Cycle

The following was prepared by the Department of the Aerospace Engineering, University of Maryland, in explaining the operation of the engine. The near-adiabatic cycle is a closed thermodynamic cycle that makes use of three fluid volumes: the hot reservoir, the working cylinder, and the cold reservoir, noting that the expansion and pump volumes are now combined within the working chamber to comprise the working cylinder volume. Valves alternately connect each reservoir to the working cylinder in a way that causes the working fluid to be cycled and the piston to be driven up and down.

Graph 1 a and b illustrate the variations of pressure and temperature in the three volumes over the course of a cycle. Beginning at bottom dead center (BDC) or 180 crank angle degrees (CAD), the piston moves upward compressing the working fluid in the cylinder. Fluid in the cold reservoir is also compressed because the cold reservoir spool valve separating the cold reservoir and working cylinder is open. The inlet valve closes around 280 CAD trapping cooled working fluid in the cylinder. The upward motion of the piston compresses the trapped, cool, fluid until its pressure reaches that of the hot reservoir around 340 CAD. At this point, one-way reed valves at the top of the cylinder open allowing the cooler working fluid to flow into one end of the hot reservoir labyrinth. These valves close when the pressures in the cylinder and hot reservoir equalize at top dead center (TDC, 360 CAD).

The inlet valve, separating the other end of the hot reservoir labyrinth from the cylinder, opens immediately after TDC admitting hot, high pressure working fluid from the hot reservoir to the volume above the piston. This gas begins to expand pushing the piston down. The hot reservoir inlet valve closes shortly thereafter (at ~380 CAD) and the bolus of hot working fluid trapped in the cylinder continues to expand doing work on the piston. The cold reservoir connection valve opens near bottom dead center (BDC, ~40 CAD) allowing cool working fluid from the cold reservoir to enter the cylinder and mix with the expanded fluid from the previous cycle. The cold reservoir connection valve closes ~100 CAD after BDC and the cycle repeats. Graph 1b shows that the temperatures of the hot and cold reservoirs change very little (<5%) over the course of the cycle indicating that heat addition and removal processes are nearly isothermal as in the Carnot cycle. Graph 1c shows the p-V diagram for the fluid in the working cylinder. Finally, it should be noted that the crank angle resolution in Graph 1 has been degraded intentionally to facilitate the creation of the annotated plots. The 'real' pressure and temperature traces produced by the model are much smoother. Referring to the drawings in FIG. 1, Graph 1, (a), (b), and (c), property variations in reservoirs and working cylinder are shown over the course of a single cycle.

The intake and exhaust ports at the top of the cylinder connect, respectively, to the outlet and inlet ports of a shell and tube heat exchanger. The 'hot reservoir' is the internal volume of the 'tube' portion of the heat exchanger plus the volume of the connections between the exchanger and the engine. The shell of the cold side heat exchanger has been removed to expose the tubes whose internal volumes form the cold reservoir. The figure also shows the valves separating the reservoirs from the working cylinder. Reed valves at the top of the cylinder prevent backflow from the hot reservoir (which is at elevated pressure) into the cylinder. A cylindrical rotary valve isolates the cold reservoir from the working cylinder at the appropriate points in the cycle. A circular plate rotary valve at the top of the working cylinder opens to permit flow from the hot reservoir to the working cylinder at appropriate points in the cycle.

Modeling Results

A control volume approach applied to the hot reservoir, cold reservoir, and working cylinder is used to develop a quasi-one-dimensional model of the engine's performance. Pressure losses associated with the flow of fluid through various tubes and orifices are accounted for using correlations that are appropriate for the geometries of the flow passages shown in this disclosure. Similarly, heat transfer in the hot and cold reservoirs is modeled using empirical correlations for the performance of shell and tube heat exchangers. The time-dependent conservation equations (mass and energy) are integrated using a standard Runge-Kutta integrator (MATLAB's ODE45). Inputs to the calculations include initial pressures and temperatures in the three volumes at a particular crank angle, the hot and cold reservoir volumes ($V_{HR}$, $V_{CR}$), displacement, clearance volume ($V_c$), compression ratio ($r_c$), crankshaft speed, and the inlet temperatures of the hot and cold reservoir heat exchangers. The latter refer to the temperatures of the fluids entering the hot and cold side heat exchangers from the outside (i.e. The external temperature difference that the engine operates between) and not the temperatures of the hot and cold reservoirs themselves which lie inside the heat exchangers and thus will be at intermediate temperatures relative to the external temperature difference.

The simple thermodynamic model was used to identify designs that maximize power, efficiency, or Brake Mean Effective Pressure (BMEP). Over 4000 combinations of compression ratio ($4<r_c<30$), hot reservoir volume ($0.5r_cV_c<V_{HR}<50r_cV_c$), cold reservoir volume ($0.5r_cV_c<V_{CR}<50r_cV_c$), and cold reservoir initial pressure ($0.5<p_{C,i}<8$ Mpa) were explored (see Graph 2). The hot and cold reservoir temperatures were fixed at 1000K and 300K respectively to reflect realistic operating temperatures and hot and cold reservoir volumes were fixed at 0.036 $m^3$ to reflect practical constraints on device size. Note that other work showed that $V_H/V_c \sim 1$ is about optimal. Engine speed was held constant at 1800 RPM corresponding to a four-pole A/C generator operating in 60 Hz grid. The results show that a compression ratio of 12 and $V_H/V_C=1$ maximizes power output for an engine with the specified hot and cold reservoir temperatures and volumes. The optimum engine satisfying these constraints produces 5.9 kW with 28.5% efficiency. Sample p-V and T-S diagrams for the cycle are presented in Graph 3.

Referring to FIG. 1, Graph 2 shows the power output vs. compression ratio for different ranges of hot reservoir to cold reservoir volume ratio. The working fluid is air, and the speed is 1800 RPM. Referring to FIG. 1, Graph 3 shows the P-V and T-S Diagrams for the optimum power near-adiabatic cycle engine.

Similar methods can be used to identify configurations that maximize efficiency. Graph 4 shows that efficiencies in excess of 50% are attainable in designs that produce useful levels of power output using only a moderate temperature difference. Increasing the hot reservoir temperature significantly improves performance while increasing speed increases power for a while but at the expense of efficiency. Since the work/stroke decreases with speed (because the rate of heat transfer in the heat exchangers cannot keep up), power output peaks at about 3700 RPM and decreases with further speed increases. Graph 4 summarizes the levels of performance that are available from this size engine operating between 1000K and 300K when the engine is optimized for either power output, efficiency, or BMEP.

Refer to FIG. 2, Graph 4: The effect of hot reservoir temperature (a) and operating speed (b) on the power output and efficiency of a near-adiabatic cycle engine optimized for efficiency. The working fluid is air, $V_H=V_C=0.036$ $m^3$, $T_C=300K$ and $r_C=15$. Refer to FIG. 2, Table 1: Performance of near-adiabatic cycle engines optimized for power, efficiency, and BMEP at 1800 RPM, $T_H=1000K$, $V_H=V_C=0.036$ $m^3$, $r_C=15$ and with air as the working fluid. Refer to FIG. 2, Table 2: Performance of some typical Stirling engines.

The Valving Interchange of the Working Chamber and the Flow Capacity of the Disclosed Model The opening of the inlet valve 121 must provide optimum flow from the hot heat exchanger 500 to the expansion chamber 702 in the working cylinder. Therefore, a delay means that allows the valve to rapidly snap shut will be designed into the valve mechanism. The featured model is designed with bevel gears 151 and 152, having a ⅕ ratio, meaning the valve frame 130 will rotate one time in five rotations of the crankshaft 141. The valve frame has five openings, meaning that the valve will open once per rotation of the crankshaft 141. The pulley ratio between the valve pulley 806 and the crankshaft pulley 143 is 1/1. Four valving mechanisms interact with the working chamber volume 104: 1) the valve frame 130 with its five inlet valves 121 allows for the timed TDC injection from the hot heat exchanger 500; 2) the BDC port opens when the working piston 103 nears the BDC position and uncovers the BDC ports, exposing access of pressurized cold fluid from the cooling reservoir 600 to the working cylinder 104 (in tandem with the opened valve 122); 3) the valve 122 between the working chamber 104 and the cooling reservoir 600, located at the TDC position right before the pump volume, will remain open during almost the entire near-adiabatic portion of the upstroke, allowing the fluid in the working chamber 104 to be compressed back into the cooling reservoir 600. This valve will also be designed to rapidly snap shut; and 4) the unidirectional check valve 126 accesses flow from the pump chamber volume 701 to the hot heat exchanger 500, providing unidirectional flow out of the engine 400 through the pump chamber volume 701 back into the high pressure/temperature hot heat exchanger 500.

The Engine Valves:

1) The upper portion of the rotating valve frame 130 houses inlet valve 121 which has five (5) slit openings, spaced equal distance around the valve frame circumference, moving within the walls of the valve mechanism 130. At 1800 RPMs, the valve frame 130 with its five slits rotates one complete rotation per five rotations of the crankshaft. Since the gear ratio for the bevel gear is ⅕, as explained and since the belt pully ratio between the cam and crankshaft is 1 to 1, the valve frame rotates (at 1800 RPM) 30 seconds/5:1 ratio=6 times a second. The projected total opening will be 15.56 $cm^2$. However, designing into the valve mechanism a means of snap closing the valve will ensure that the nearly isothermal (filling of the expansion volume) and near-adiabatic expansion downstroke distinction will be sharper. As such, if the required openings do not need to be generous, the impact of a tighter cosign on the TDC action would improve. For example, if the TDC action straddles TDC with a 15 degree approach and a 15 degree descent, the cosign would be 15 degree Cosign=96.6% for the near-adiabatic expansion. But, if the timing of the TDC opening is reduced to a 11.84 degree Cosign, the system would improve to a 97.9% near-adiabatic range.

2) Approaching BDC, BDC ports 124 allow the rapid flow of the pressurized cold fluid in the cooling reservoir 600 back into the working chamber 104. With a 30 degree rotation of the crankshaft 141 at BDC and with a 7 mm tube diameter, each opening would have a 38.5 $mm^2$ opening aperture. 38.5×30 openings would be a total of 11.55 $cm^2$ which is a 1.8 $in^2$ opening. If the rotation range at BDC has a tighter cosign angle, this would decrease the time exposure of the opened ports 124 at BDC but would improve the engine efficiency.

3) The upper ports between the working chamber 104 and the cooling reservoir 600 (located right before the pump volume) are shown with a 23.56 $cm^2$ maximum aperture opening. Designing into the valve mechanism as a snap closing means will sharpen the distinction between the near-adiabatic upstroke and the pumping of the working fluid from the pump volume 701 into the hot heat exchanger 500. If the rotation range at BDC has a tighter cosign angle, this would decrease the time exposure of the opened ports 124 at BDC but would improve the engine efficiency.

4) The check valve 126 from the pump chamber volume 701 to the hot heat exchanger provides unidirectional flow out of the engine.

The Containment Furnace

This disclosure shows the previously patented design of a containment furnace that provides the heat that drives the disclosed engine 400 and its generator. Encased inside a light-weight silicone shell material, the furnace 900 uses an interior conventional heat exchanger 500 to feed heat to the engine 400. The furnace 900 is fired up using a conventional furnace gas/air nozzle 903. However, previous disclosures of the engine concept include several other heat exchanger options for its multi-application uses. Heat is drawn off the interior heat exchanger 901 (the heat exchanger 500) as the engine receives its boluses of hot working fluid 703, driving the engine cycles. As that fluid cycles, its heat energy is converted to work output, and is returned to the containment furnace 900 for reheating through port 123 from the engine 400 to port 905 of the furnace. In the home furnace configuration, any fumes exhausted from the containment furnace 900 pass through the exit flue 906, and flow into and through the hot water heat and HVAC as needed (see FIG. 15). The configuration of the heat exchanger can be a spiraling coil or other configurations including fins if desired.

Preventing Engine Lock when Idle

The containment furnace is shown so as to explain that, when the engine stops, unavoidable leakages will seep into and out of the internal volumes of the engine 400—into and out of the working chamber volume 104, of the cooling reservoir volume 600, of the expansion chamber volume 702, and of the pump chamber volume 701. These leakages will allow the high pressure fluid in the hot heat exchanger 500 to flood the system. When this happens, when the working fluid 703 in the engine 400 is not in its cycling mode, the engine 400 will tend to lock up. To prevent such lockage, a bridge valve 201 between the expansion chamber 702 and the engine 400 will close off at ports 203 and the access of the high pressure/temperature working fluid when the engine stops. However, as the bridge valve closes, a loop is opened allowing flow through the loop port 202 from the exhaust back into the engine so that the engine can be easily turned over to gain momentum. When the engine does gain momentum, the bridge valve opens. This will minimize the resistance of internal pressures within the engine during startup.

Examples

The initial intended use of the near-adiabatic engine 400 and its disclosures is for generating electricity in the home. The near-adiabatic engine 400 is designed to drive a gas-driven home generator 1000. Any heat-driven home generator, that shares its heat with other furnace room appliances, will achieve exceptional efficiency, but, with a highly efficient Combined Heat to Power (CHP) engine such as disclosed, the cost-efficiency should triple. As shown, the disclosed gas-driven engine 400, driving a home generator, integrated into the home HVAC and hot water heater, is projected to achieve as much as 46% efficiency. This disclosed CHP engine, drawing its heat from a containment furnace 900 between 1230° F. and 742° F., with the heat flow through the furnace 900 controlled so as to optimize the system efficiency, further ensures that nearly all the heat will be converted into usable energy. Overlapping and sharing heat between the near-adiabatic CHP unit and other furnace room appliances will ensure that little additional heat will be required above the winter consumption of central heating and the summer consumption for cooling. As a point of interest, the average summer cooling requirement is ~⅓$^{rd}$ that of the required heat for winter.

Small lawnmower and aviation SI engines, like Honda's Freewatt, are only 21.6% efficient. The WhisperGen, a Stirling engine, is awkwardly designed and achieves only 15% efficiency. Larger engines are generally more efficient. A four-cylinder Kockums, for instance, with 25-kW power, if reconfigured as a one-cylinder engine, would suffer ¼$^{th}$ the internal losses while generating 25/4 kW the power, approximately 6-kW power. The single-cylinder engine 400 herein disclosed, sized to the Kockums with a flywheel and an efficient alternator generator serving both as an engine starter and a generator, having 20% greater efficient, would have 7.5-wK power. A 2-kW Gas-Tricity generator for homes with a nearly adiabatic cycle, 20.1% mechanical and 5% thermal losses, and a projected 46% efficiency, would require 2.67-kW heat conversion.

Other Intended Applications for the Engine

Broader heat-to-work conversion needs will be met as other applications of the engine enable for cheaper generation while reducing greenhouse emission. Optimized heat-to-power conversion will reduce energy consumption, thus reducing greenhouse emissions. The focus in this patent is on developing the practical near-adiabatic engine design for the Gas-Tricity Home Generator. So far, the breakthrough has identified five heat-to-power engine applications. Projections show:

1) savings herein described associated with the GTHG, 2) savings in electricity generation from high-grade industrial waste heat of 2.882 GW year, costing $615.7 million compared to nuclear power plant generation at $13.7 billion or 23 times more cost-efficient;

3) thermal-solar savings, using the same solar array but in small engine clusters, replacing the 18% efficient Ivanpah 392 MW steam turbine with multi 46% efficient 1.1 MW versions of the near-adiabatic CHP engine units, the plant cost-efficiency can improve 2.5 times;

4) savings from distributed generation for large buildings parallels the savings using the GTHG; and 5) cars can get 80 mpg.

During the first two years of GTHG commercialization, if 5,000 homes are built containing the GTHG, their homeowners will save a total of over $1.6M per year on utility bills, and its environmental impact on the environment would aggregate removal of 25,000 tons of $CO_2$ from the atmosphere (equivalent to removing 3,582 cars from the road).

DETAILED DESCRIPTION OF THE FIGURES

FIG. 1 refers to the analysis presented on page 9 using Graph 1, (a), (b), and (c) to demonstrate the Property variations in reservoirs and working cylinder over the course of a single cycle. On page 10, Graph 2 shows the power output vs. compression ratio for different ranges of hot reservoir to cold reservoir volume ratio. The working fluid is air, and the speed is 1800 RPM. Graph 3 shows the P-V and T-S Diagrams for the optimum power near-adiabatic cycle engine.

FIG. 2 refers to the analysis presented on pages 9 and 10 with Graph 4 showing the effect of hot reservoir temperature (a) and operating speed (b) on the power output and efficiency of a near-adiabatic cycle engine optimized for efficiency. The working fluid is air, $V_H$=$V_C$=0.036 m$^3$, $T_C$=300K and $r_C$=15. Table 1 refers to the performance of near-adiabatic cycle engines optimized for power, efficiency, and BMEP at 1800 RPM, $T_H$=1000K, $V_H$=$V_C$=0.036 $m^3$, $r_C$=15 and with air as the working fluid. Table 2 refers to the performance of some typical Stirling engines.

FIG. 3 compares a Stirling engine with the disclosed near-adiabatic engine. For Stirling, the entropies in each chamber rise during the expansion power-stroke and fall during the compression stroke, i.e., adding heat to and removing heat from the working cylinder that is not utilized as work output; that is: Qexp+Qheat−Qcool−Qcomp=Wexp−Wcomp. An ideal adiabatic cycle has no $Q_{exp}$ and $Q_{comp}$ (heat in and heat out) during its expansion and compression; that is: Qheat−Qcool=Wexp−Wcomp. The disclosed nearly adiabatic engine approaches this ideal adiabatic cycle because: 1) Its injected hot bolus is isolated before the power-stroke adiabatically expands from Top Dead Center (TDC) to Bottom Dead Center (BDC). 2) At BDC, that expanded working fluid is rapidly cooled by mixing with cooled pressed fluid from the cooling reservoir. 3) During the upstroke, that cooled fluid is near-adiabatically pressed into a pump volume with the remainder near-isothermally compressed back into the cooling reservoir, removing the heat in preparation for the next cycle. 4) Finally, at TDC, the fluid in the pump volume is pressed back into the heat exchanger for reheating. Thus, the proprietary fluidic switching mechanism enables the engine to closely approximate the near-adiabatic expansion/compression processes of an ideal Carnot cycle.

Figure 4A:
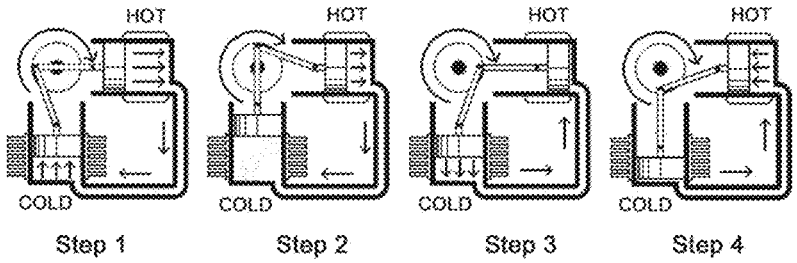
FIGS. 4*a* and 4*b* show eight steps that describe the four stages of the near-adiabatic cycle and compare the eight steps to the four-cycle stages shown in the p-V diagram.
Figure 4B:
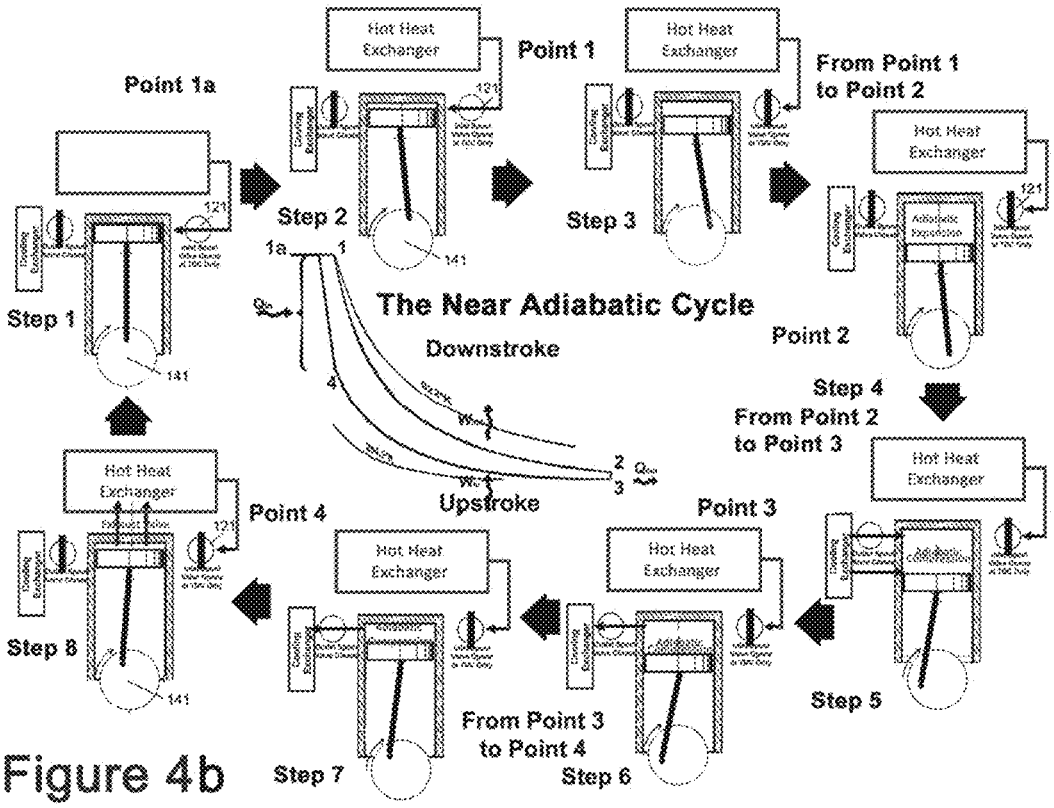

FIGS. 4*a*-4*b* show eight steps in an operational cycle of the engine. Its corresponding p-V diagram references the four points in the cycle. The steps are simplified so to better explain and help visualize the engine's operation. This disclosure describes an engine 400 with a spinning valve frame mechanism 130 having five openings feeding into the engine 400 and five openings connecting the working chamber 104 to the cooling reservoir 600. The valve frame 130 (rotating with its 30 inlet openings 121) momentarily opens access once every 1/30 of a second. These five openings are housed in the valve frame 130, providing five shutter openings per revolution. After the flow between the cooling reservoir 600 and working chamber 104 closes, openings of the inlet valve 121 align and synchronize to open the flow from the high temperature/pressure hot heat exchange. For simplicity and clarity, the steps herein focus on describing a single cylinder cycle of the engine 400, using a flywheel 145 to carry the momentum through the compression upstroke. However, the engine concept and the principles and lessons taught herein are in no way limited to the configuration of a single cylinder engine. One major design concern for achieving optimum performance has been the configuration of the inlet valve 121 so as to supply sufficient flow of the initial bolus into the engine 400. Note that the recommended speed of the engine is 1800 RMPs, meaning that the crankshaft 141 of a single cylinder engine 400 will cycle 30 times a second. To achieve the optimum bolus condition in the expansion chamber 702, complete flow must be met within the 1/30 per second timeframe. The steps shown in FIGS. 1-5 describe the sequence of the flow through the cycle.

Figure 5:
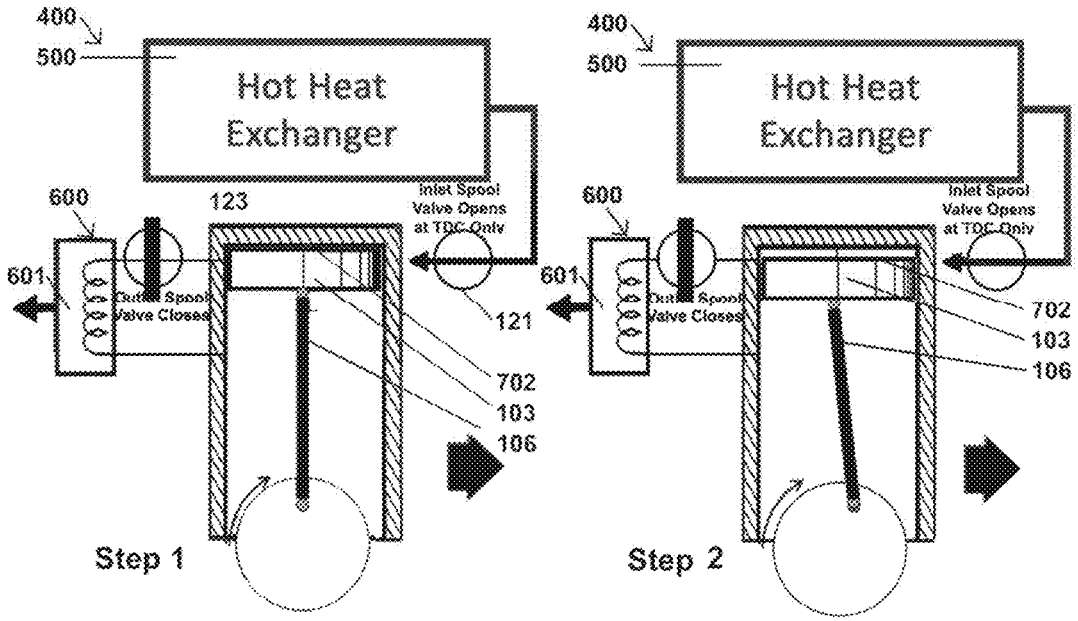
FIG. 5 describes, in Steps 1 and 2, the opening of the inlet valve to the expansion chamber, allowing a bolus of high pressure/temperature working fluid from the hot heat exchanger to be injected into the expansion volume in preparation for the near-adiabatic expansion downstroke.

FIG. 5 describes the first two steps. Step 1, as referenced to in the p-V diagram of FIG. 1, occurs between points 4 and 1 (Stage 4) of the cycle, when the cycled working fluid 703 has been pushed out of the engine 400 and received in the hot heat exchanger 500. Note here that the inlet valve 121 from the hot heat exchanger 500 momentarily opens, allowing the high temperature/pressure fluid to enter the opened expansion chamber volume 702, injecting a fresh bolus of working fluid 703, energizing the next downstroke. Note that this action occurs at TDC or at point 4 in the cycle and as is shown in the p-V diagram. As this transfer of working fluid 703 reheats in the hot heat exchanger 500, note that the hot heat exchanger 500 volume must be large enough so that the influx of the cooler working fluid 703 from the engine 400 does not significantly affect the pressure/temperature conditions in the larger hot heat exchanger 500 volume. Step 2, as referenced to in the p-V diagram of FIG. 1, begins at point 1, at TDC, when the volume hot bolus fills the expansion chamber 702 defined by shutting off the inlet valve port 121. That defined volume is filled with the high pressure/temperature working fluid 703 from the hot heat exchanger 500. Filling of the expansion chamber 702 occurs with the momentary opening of the inlet valve 121 and the alignment of the five slit openings on the valve frame 130. The total effective area of the openings of the inlet valve 121 is 15.56 $cm^2$. After inlet valve 121 from the hot heat exchanger 500 to the expansion chamber 702 closes, Step 3 begins with the working fluid 703 expanding, forcing the working piston 103 downward. The stroke moves from point 1 to point 2 (Stage 1) as shown on the p-V diagram and in the schematic drawings.

Figure 6:
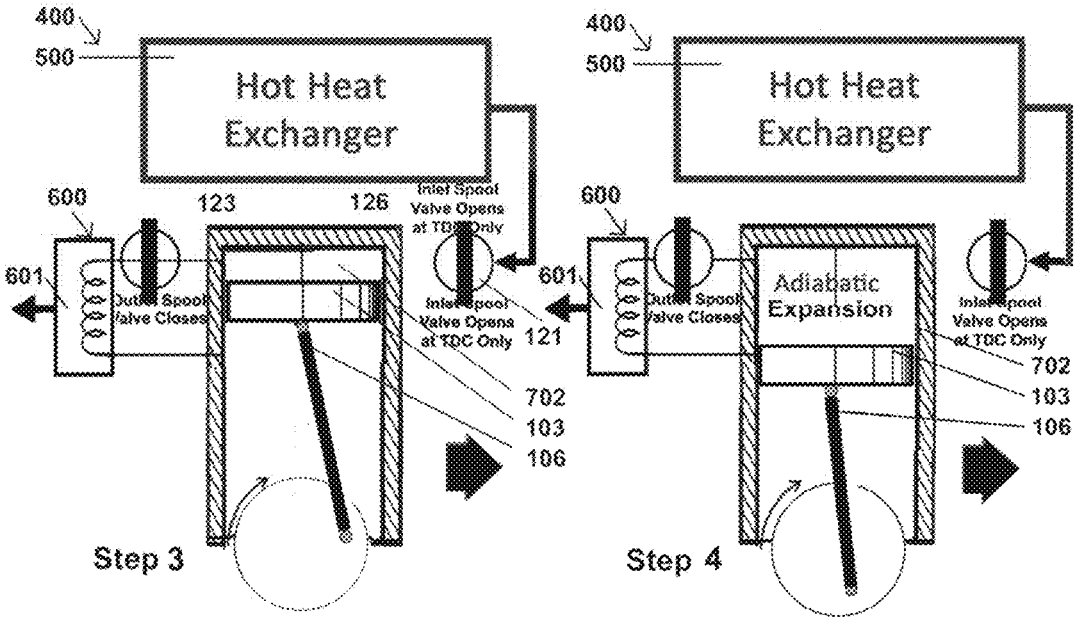
FIG. 6 describes, in Step 3 and 4, the positive work acting on the working piston between near TDC and near BDC position, between when the inlet valve closes, isolating the injected bolus, and before the uncovering of the BDC uniflow ports releasing the pressurized cool fluid in the cooling reservoir into the working chamber.

FIG. 6 shows steps 3 and 4. Step 3 begins after the inlet valve 121 closes, when the working fluid 703 in the working chamber 104 is near-adiabatically expanded in isolation. This expansion continues until the working piston 103 almost reaches BDC. The isolated potential heat energy in the working chamber 104 will be converted to real work output. Since a near-adiabatic expansion is reversible, the same real work input can be put back into the heat condition by recompressing that fluid without any outside interference or losses, converting the work back into heat potential. For example, if an equal amount of work is put back into the working chamber 104 through the anti-work of a recompression upstroke and if that recompression work on the working fluid 703 occurs without any heat addition or lost occurring either through the walls of the working chamber or otherwise, then that active compression work would be converted back into its original heat energy potential as was at TDC. Step 4 shows that point right before the working piston 103 uncovers the BDC uniflow ports to the cooling reservoir 600 at near BDC. Note that, to avoid recompression during the upstroke with equal work input, heat energy will be removed from the working chamber 104 at BDC after the working fluid 703 has expanded and before that working fluid 703 is recompressed. Although the temperature of the working fluid 703 drops with downstroke expansion, the heat energy in that working fluid 703 is not removed unless by some outside source. Without heat removal, recompression will require the same work input to return to the same level of heat potential.

Figure 7:
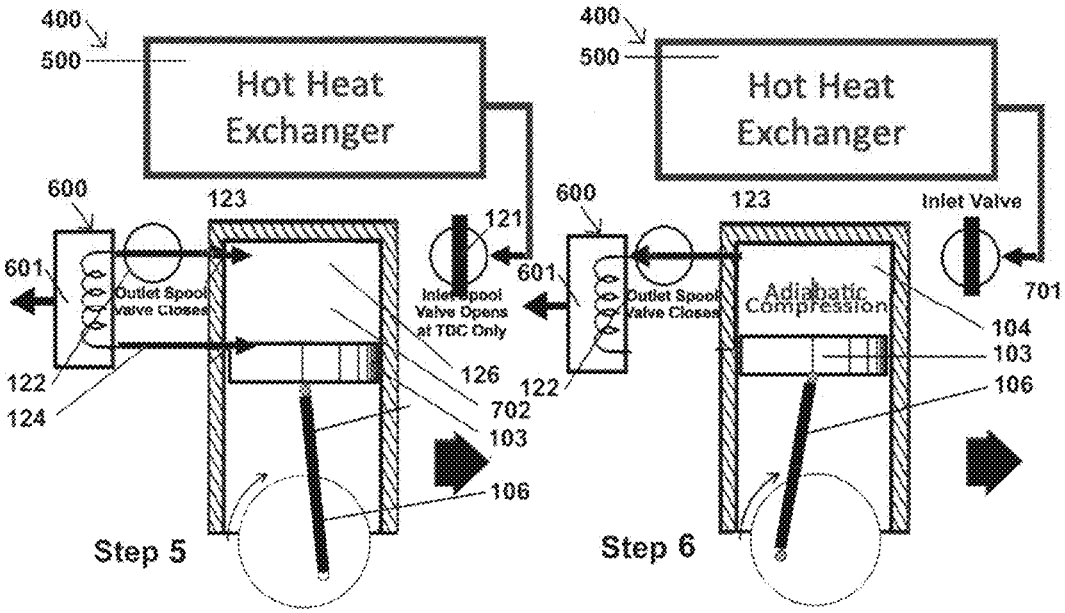
FIG. 7 describes, in Step 5 and 6, the simultaneous uncovering of the BDC uniflow port and the opening of the near TDC port between the cooling reservoir and the working chamber, releasing the pressurized cool fluid from the cooling reservoir into the working chamber before beginning of the compression upstroke of that said cooled working fluid in that said working chamber.

FIG. 7 shows steps 5 and 6. Step 5 begins when the pressurized cold fluid from the cooling reservoir 600 is released into the working chamber 104. As the piston cycle bottoms out at BDC and begins its upstroke, the injected cold fluid, released from the cooling reservoir 600 into the working chamber 104, removes heat from the working fluid 703, bringing the temperature and pressure down to the low sink level, matching points 2 and 3 (Stage 2) on the p-V diagram and as described in its drawings. Step 6 begins with the compression upstroke at the cooler temperature and lower pressure (with the optimum heat removal). From point 3 to point 4 (Stage 3), the working fluid 703 is pressed into the pump chamber volume 701. Likewise, the fluid 703 in the working chamber 104 is pressed back into the cooling reservoir 600 through the open port 122, located at the top rim of the working cylinder 104. The access port 122 to the cooling reservoir 600 remains open during the entire upstroke and as is shown in the drawings of the upstroke from point 3 to point 4 (Stage 3). Note that the fluid being pressed into the cooling reservoir 600 is kept at the cool low temperature level, thus removing the heat energy so that the density in that fluid will rise (in the proposed temperature bracket) to almost twice the density of the higher energy working fluid 703 being compressed in the pump chamber volume 701. In raising the density, heat in the fluid is removed and that cooled fluid is stored in the cooling reservoir, making ready for the next BDC injection and supercooling before the next upstroke recompression.

Figure 8:
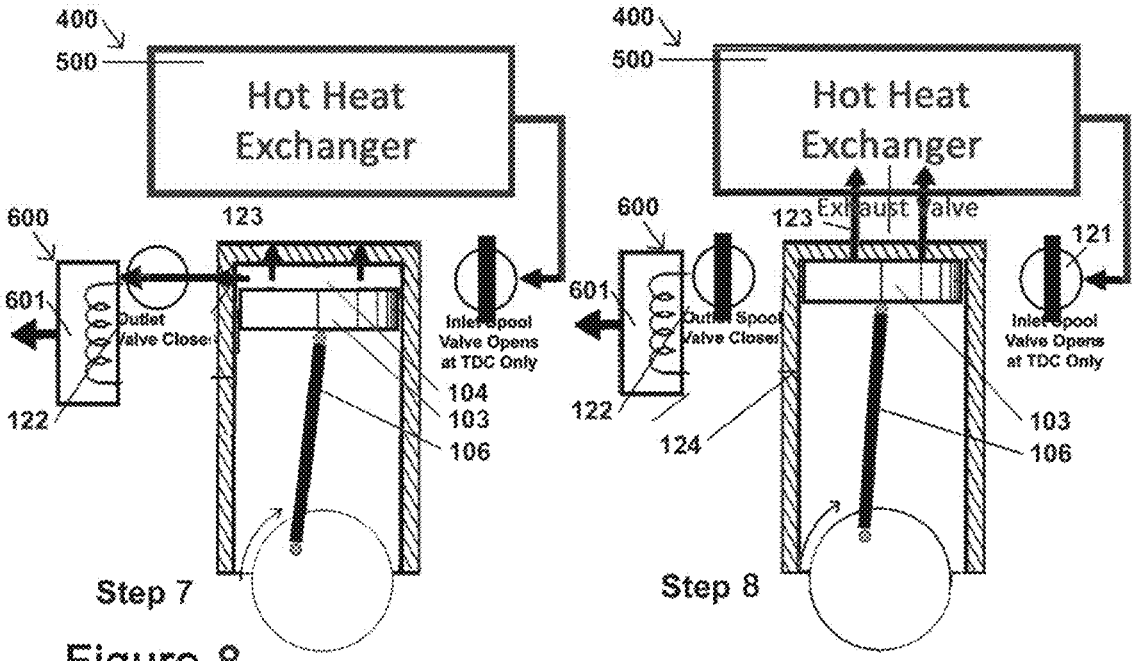
FIG. 8 describes, in Step 7 and 8, the completion of stage (4), Step 7 being after the near-adiabatic compression upstroke is completed, after pressing the cooled working fluid into the cooling reservoir and into the pump volume and after the closing of the connecting valve between the working chamber and the cooling reservoir, and Step 8 showing the pumping action back into the high pressure/temperature hot heat exchanger. The compression upstroke occurs between Step 6 and Step 7.

FIG. 8, shows step 7 and Step 8. Step 7 begins when the upstroke reaches the point approaching TDC wherein the pump volume is defined. At this position, the access port 122 to the cooling reservoir 600 closes, and immediately, the working piston begins to act strictly as a pump, pressing the volume of working fluid inside the fluid pump 700 volume out from the engine through the check valve 126 to the hot heat exchanger 500. Step 8 is the point when the pumping action has been completed and all the working fluid has been pushed back into the hot heat exchanger 500. The check valve 126 assures that the flow of the working fluid 703 will be unidirectional as the working fluid 703 in the cycle is forced back into the hot heat exchanger 500. With the working piston 103 acting as the pumping mechanism, the injection of a new bolus from the hot heat exchanger 500 does not enter into the engine 400 until the working piston has reached TDC (returning to Step 1).

Figure 9:
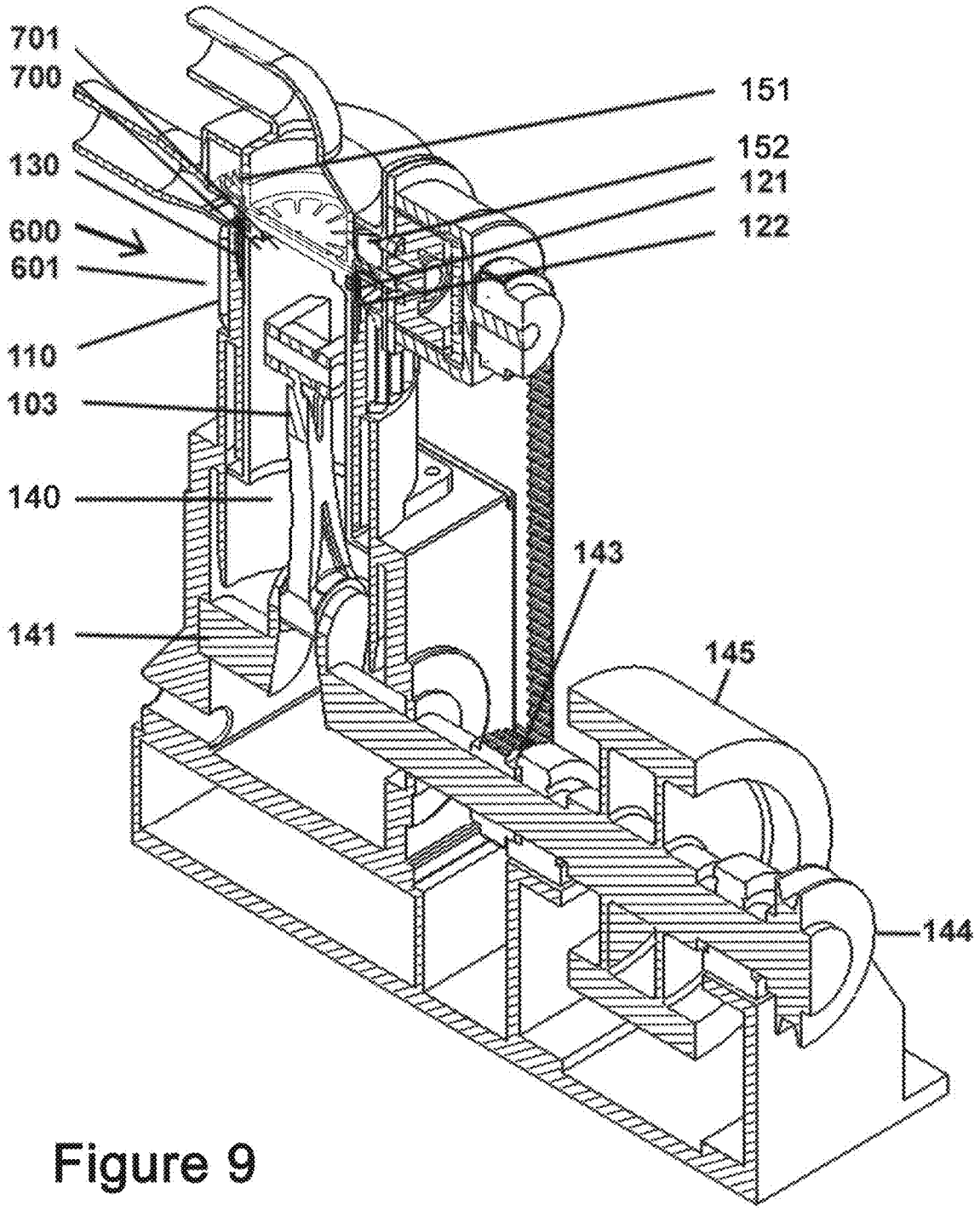
FIG. 9 is an isometric view showing a yz cross-sectional view of the near-adiabatic engine and showing the operation of the valve mechanism with the inlet port into the engine, the connecting valve between the cooling reservoir and the working chamber, and the outlet check valve port back into the hot heat exchanger whereas the working fluid is cycled through the engine so as to convert the available heat energy into the optimum usable power output.

FIG. 9 describes the engine 400 configuration with its inlet port 121 to be attached to the hot heat exchanger 500 and an outlet check valve 126 (interior to the engine) which also accesses the cycling pump volume 701 (interior to the engine) into said hot heat exchanger 500, as previously patented. The two connections 121 and 126 provide access to a balanced pressure environment (interior to the engine) but in intercourse with the high pressure state in the hot heat exchanger wherein the working fluid 703 (interior to the engine) is allowed to cycle through the engine 400 with minimum internal resistance, converting an optimum portion of the heat energy into usable power output 101. Note that the operation of the inlet valve 121 and the connection valve 122 between the cooling reservoir and the working chamber is driven by a belt 800 connection to the main crankshaft 141. Note that cooling reservoir 600 is positioned conveniently and snuggly around the outer wall of the working cylinder 104 (interior to the engine) to prevent dead volumetric waste pockets. Tubes 110 (interior to the engine) of the cooling reservoir are cooled by either the ambient air or water. Note that the power output creates torque on crankshaft (driveshaft) 141 and on belt pully 143 which, through its belt pully 806 connection, drives the inlet valve 121 (interior to the engine) and the valve of the cooling reservoir 122 (interior to the engine).

Figure 10A:
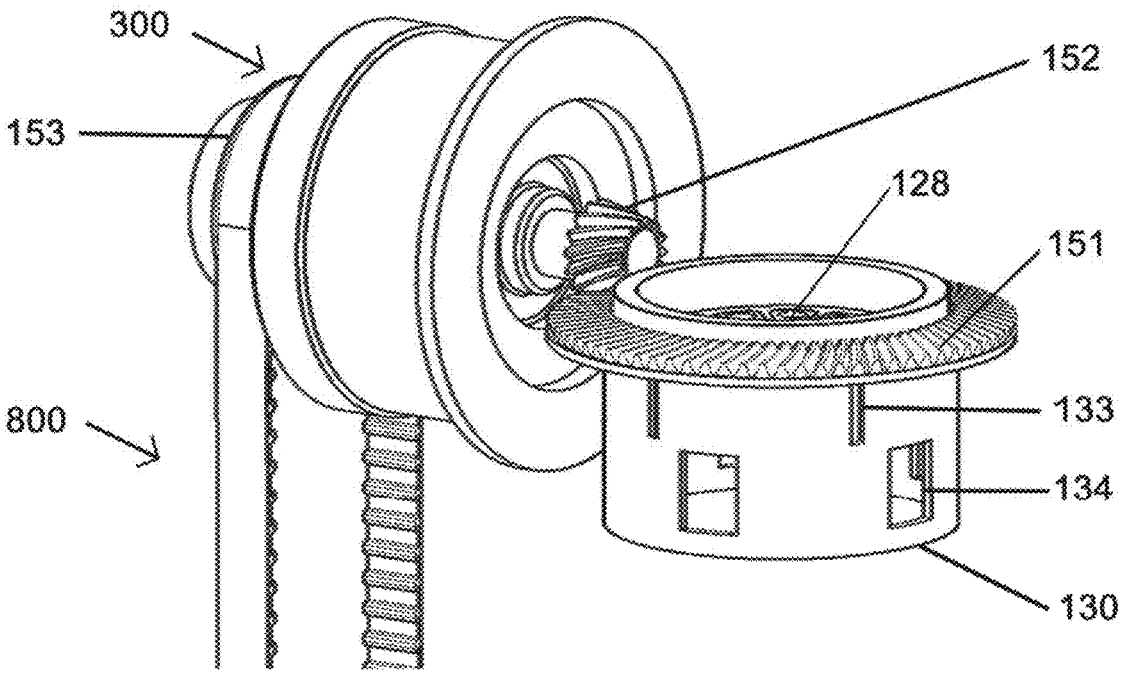
FIGS. 10*a* and 10*b* show the valve mechanism with a magnetic coupling that prevents leakage. The drawings show the relative placement of the two valves mounted on the valve frame, the lower valve ports interconnecting the cooling reservoir and the working chamber, and the upper slip valve ports serving as the intake of the injected bolus of working fluid from the high pressure/temperature into the expansion chamber before the near-adiabatic expansion downstroke, and the operation of the valves through the two bevel gears actuating the rotational movement.
Figure 10B:
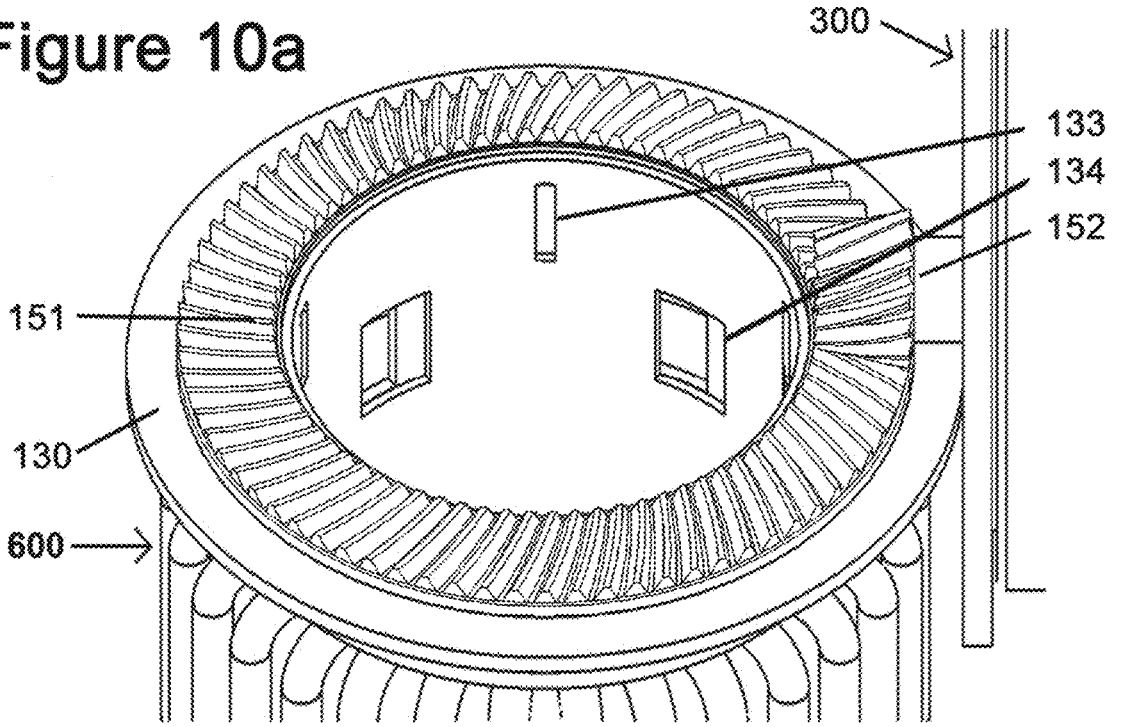

FIG. 10 is a detail side view showing the operation of the valve frame 130 that houses the inlet valve 121. As shown, the valve frame 130 is driven by the bevel gears 151 and 152 drive the rotating inlet valve 121, and the valve connection 122 between the cooling reservoir 600 (not in the figure) and working chamber 104 (not in the figure). As explained earlier, the valve frame 130 rotates 6 times per second to open the inlet valve 121 30 times in that second in sync with the 30 rotations per second of the main crankshaft 141 (not in the figure). It shows the port 122 between the cooling reservoir 600 and working chamber 104 that is open during almost the entire upstroke so as to optimize the flow back and forth, as explained in item 2 in the section called The Valving Interchange in the Working Chamber and the Flow Capacity of the Disclosed Model. Note that the connecting belt 800 between the crankshaft 141 (not in the figure) and the axis of the small bevel gear 152 has a one to one pully ratio.

Figure 11:
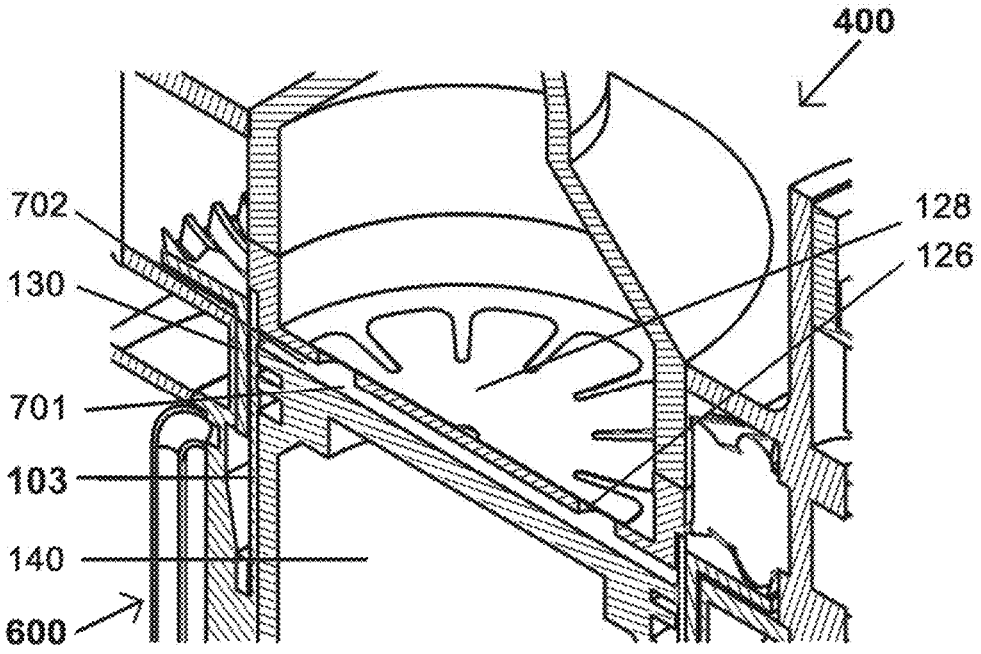
FIG. 11 shows the check valve that allows unidirectional flow between the pump volume and the high pressure/temperature hot heat exchanger during the pumping action. The drawing shows the relationship of this check valve to the valve frame mechanism, the piston action and the location and relationship of the cooling reservoir with its cooling coils.

FIG. 11 further describes, with an yz plane sectional cut, the interior workings of the engine 400 and specifically the TDC sequence that ensures the effective closing of check valve 125 during the effective closing of pump 700 in sequence with the closing of connection valve 122 and opening of the inlet valve 121. The figure shows that, as the working piston 103 approaches the near TDC position, the connecting valve 122 to the cooling reservoir 600 closes, allowing the pump 700 to begin closing.

Figure 12:
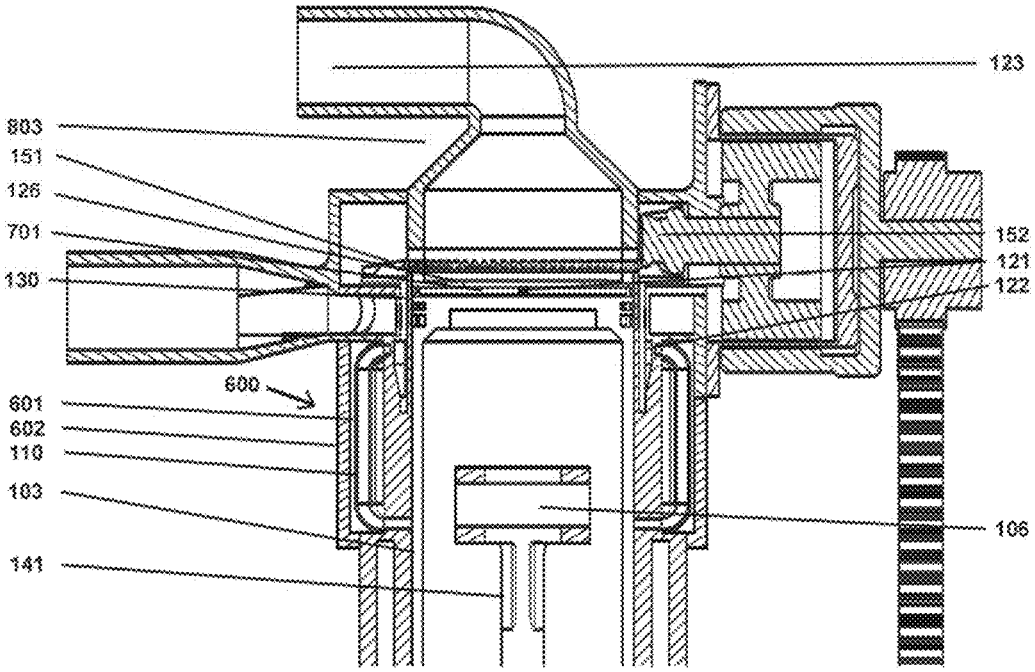
FIG. 12 is a sectional drawing of the near-adiabatic engine (cutting through using a yz plane) that further describes the relationship of the five engine chambers—expansion/pump chambers, the working chamber, the cooling reservoir and access manifolds supplying working fluid from and to the hot heat exchanger, and the four valves—the inlet valve, the connecting valve and its associated connecting uniflow valve, and the check valve.

FIG. 12 shows the engine 400 stripped of its primary outer static body parts 401, showing the interior moving parts such as the working piston 103 and its power train, and valve frame 130 train. The power train includes the flywheel 145 and power pully 144. The valve frame train includes the belt 800 connection to the valve frame 130. The gear train to the valve frame 130 and valves 121 and 122 are driven by the rotating cam rod 801. The gear train operates the valve frame mechanism 130 that houses both the inlet valve 121 between the hot heat exchanger 500 (not in the figure) and expansion chamber 701 of the working chamber 104, and the connecting valve 122 between the cooling reservoir 600 and working chamber 104. The figure also shows the flapper plate 128 of the exhaust check valve 126 that ensures unidirectional flow of the working fluid 703 from the fluid pump volume 700 out of exhaust port 123 to the hot heat exchanger 500.

Figure 13:
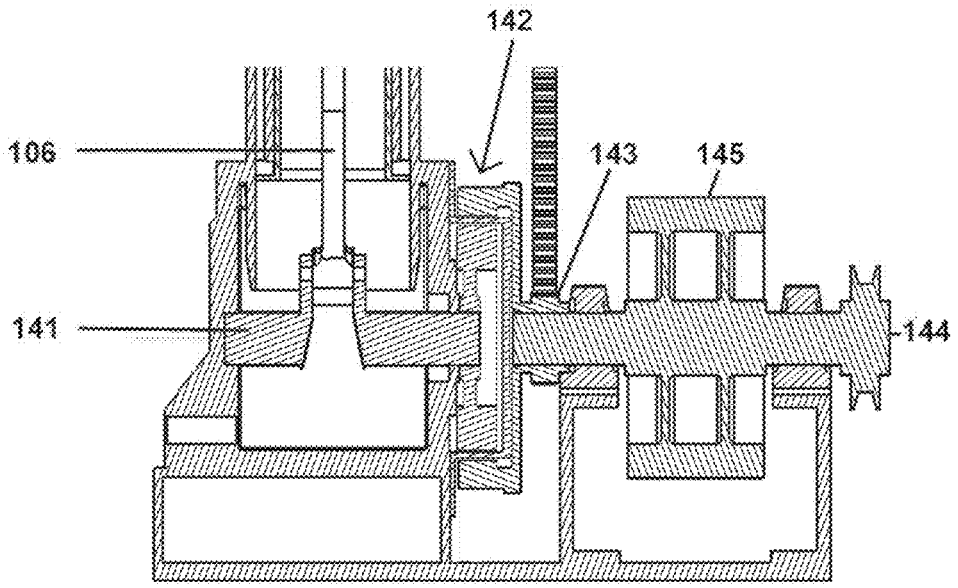
FIG. 13 shows use of a magnetic coupling that seals the engine crankcase along the axis of the main driveshaft.

FIG. 13 shows a cross-sectional elevation of the crankcase 141 and the power train, describing the transfer of power out of the engine, using a magnetic coupling 142 so as to prevent leakage along the main driveshaft 141 from the interior of the engine body to the outside. Note that the magnetic coupling 142 includes a seal wall between the outer magnetic ring and the inner magnetic. Note that the timing pulley 143 (connected to the timing belt) is mounted on the shaft 141. Note the flywheel 145 and power output pulley 144 is mounted on the shaft 141.

Figure 14A:
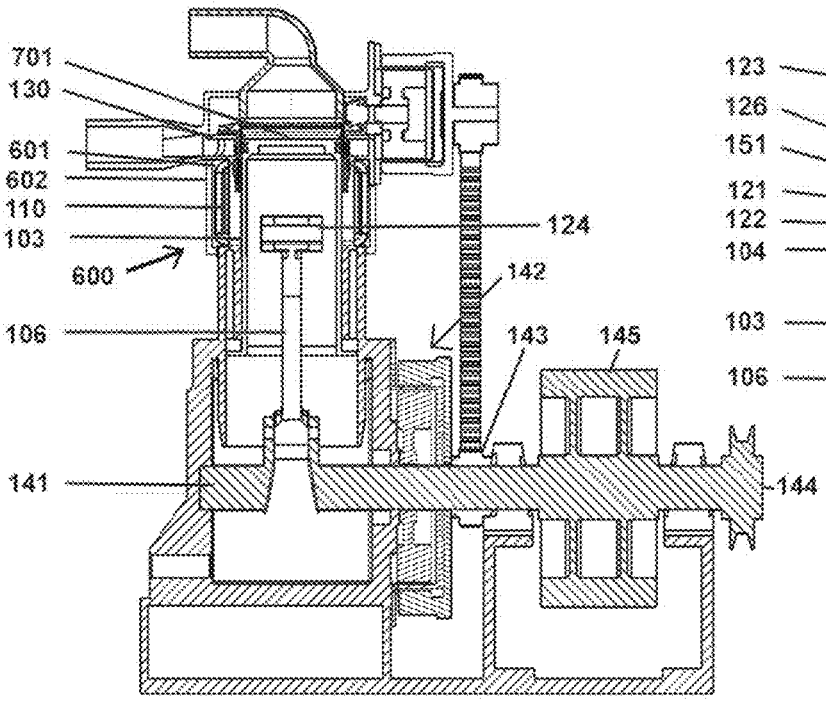
FIGS. 14*a* and 14*b* show a front and side sectional view of near-adiabatic engine, 14*a* describing in more detail the operation of the interior four valves of the cycle and the five interior volumes (expansion chamber, working chamber, pump chamber, cooling reservoir and hot heat exchanger, noting the expansion and pump volume and working chamber volumes comprise the total volume of the working cylinder) that contain the working fluid and promote the flow through those volumes during the cycle.
Figure 14B:
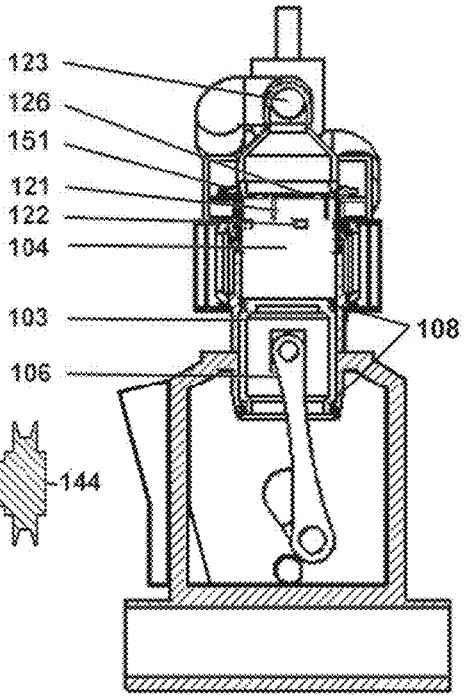

FIGS. 14*a* and 14*b* shows side and front elevations of the engine 400, but with two different designs of the piston—one that uses a bellows seal and the other that has two groups of piston rings mounted at the upper and the lower face of the piston's cylindrical surface. The figure further describes the configuration of the engine, defining the relationship of the static body 401 parts to the moving parts and specifically focusing on the four valves 121, 122, 124, and 126 and the five volumes 701, 702, 104, 600, and 500 that control the cycle. The figure gives a detailed visual description of the operation of the four valves 121, 122, 124, and 125 that directly interact with the working chamber 104 during the cycle, creating the optimum sequential operational function of the valves in that working chamber 104, and looking at the exit outlet port 123 that returns the working fluid 703 back to the hot heat exchanger 500. As mentioned above, in showing the two designs of the working piston 103, the piston on the left will use a bellows as a seal and the piston shown on the right will use two groups of O-rings at the top and bottom rims of the outer parameter. The figure shows the valve frame 130 that houses the inlet valve 121 that accesses the injected high temperature/pressure bolus of working fluid into the engine 400. They show the connecting valve 122 between the cooling reservoir 600 and working chamber 104. They show the BDC operation of the uniflow valve 124 between the cooling reservoir 600 and working chamber 104. As the working piston 103 nears BDC, simultaneously the near TDC connection valve between the cooling reservoir 600 and the working cylinder 104 opens. The figure shows the relationship of the cooling reservoir 600 to the working piston 103 as the BDC operation opens the BDC uniflow valve. Note that, as the working piston 103 approaches BDC, BDC ports 124 to the cooling reservoir 600 are uncovered, allowing the cold pressurized fluid in the cooling reservoir 600 to rush out and supercool the working fluid 703 in the working chamber 104 at BDC. Also, the figure shows the unidirectional flow from the pump volume 701 cavity, specifically showing the operation of the unidirectional check valve outlet port 123 where the working fluid exits the engine 400 and enters back into the hot heat exchanger 500.

Figure 15:
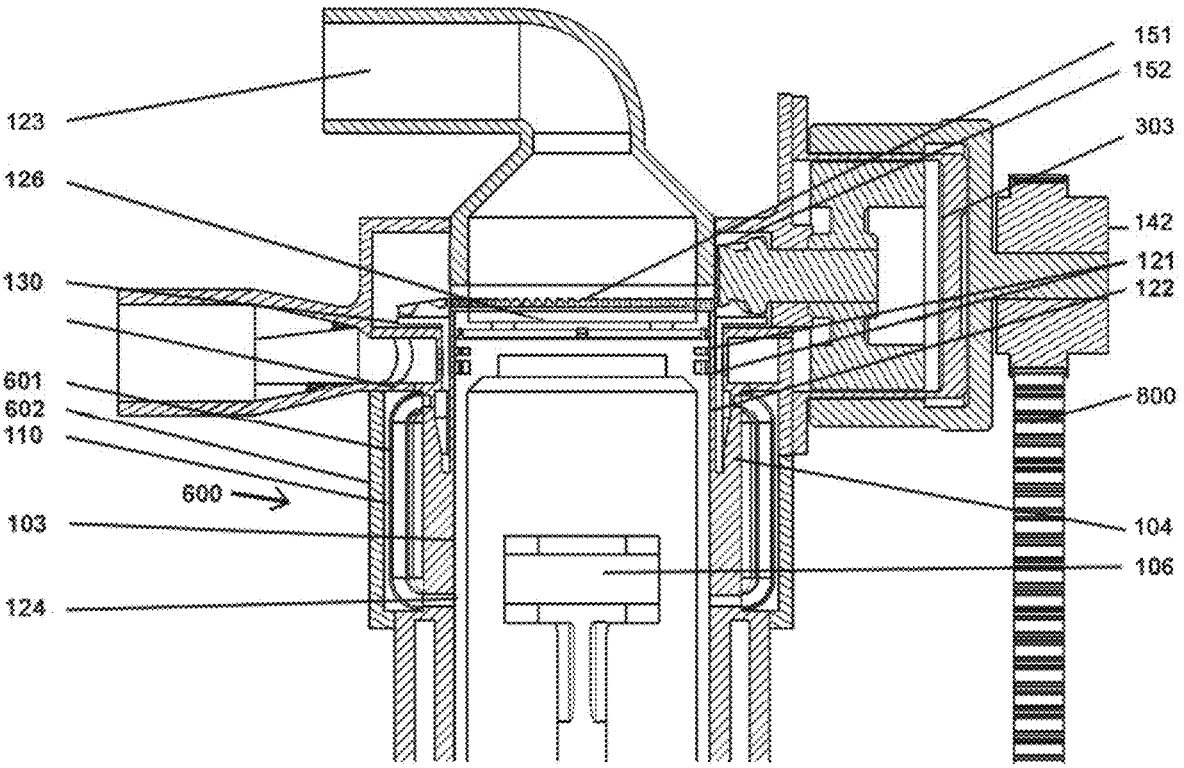
FIG. 15 describes a closer look at the valving mechanisms. (Note that the expansion chamber and pump chamber occupy the same volumetric space in the working cylinder, except the expansion chamber volume is defined during that portion injected into the expansion volume that is nearly isothermal and before the near-adiabatic downstroke. The pump chamber volume is defined during that portion of the compression upstroke after the connecting valve between the cooling reservoir and the working chamber is closed and the pumping is nearly isothermal.

FIG. 15 is a sectional view, cutting through with a plane yz, describing the interior configuration of the engine and specifically focusing on the actions of TDC and BDC valves 121, 122, and 124. The injected hot working fluid 703, that enters the expansion chamber 702 at TDC, is isolated when the inlet port 121 closes and the working fluid 703 expands, forcing downward the working piston 103. The expansion force causes the crankshaft 141 to rotate, which causes the engine output 101 and rotates the belt connection 800 to the gear train to the valve frame 130, creating the appropriate sequential operation of the valves occurring during the cycle. As the working piston 103 approaches BDC, port 124 (located at BDC) and port 122 (located at TDC) open to the cooling reservoir 600, simultaneously releasing the contained pressurized cold fluid from the cooling reservoir 600 into the working chamber 104. The released fluid at BDC supercools the working fluid 703 in the working chamber 104 at BDC before recompression. The working fluid 703 and the fluid from the cooling reservoir are mixed together. This mixture is then near-isothermally recompressed back into the cooling reservoir 600 while the remaining working fluid 703 is near-adiabatically compressed into the fluid pump volume 700. Although the BDC port valve 124 closes at the beginning of the working piston 103 upstroke, valve 122 between the working chamber 104 and cooling reservoir 600 remains open during almost the entire upstroke before defining the pump chamber volume 700. Right before reaching the pump volume 700, valve 122 closes. The pump volume 701 closes, pressing the cycling working fluid 703 back into the high pressure/temperature hot heat exchanger 500. At TDC, the inlet valve 121 opens, accessing another high energy bolus into the opening expansion chamber 702.

Figure 16:
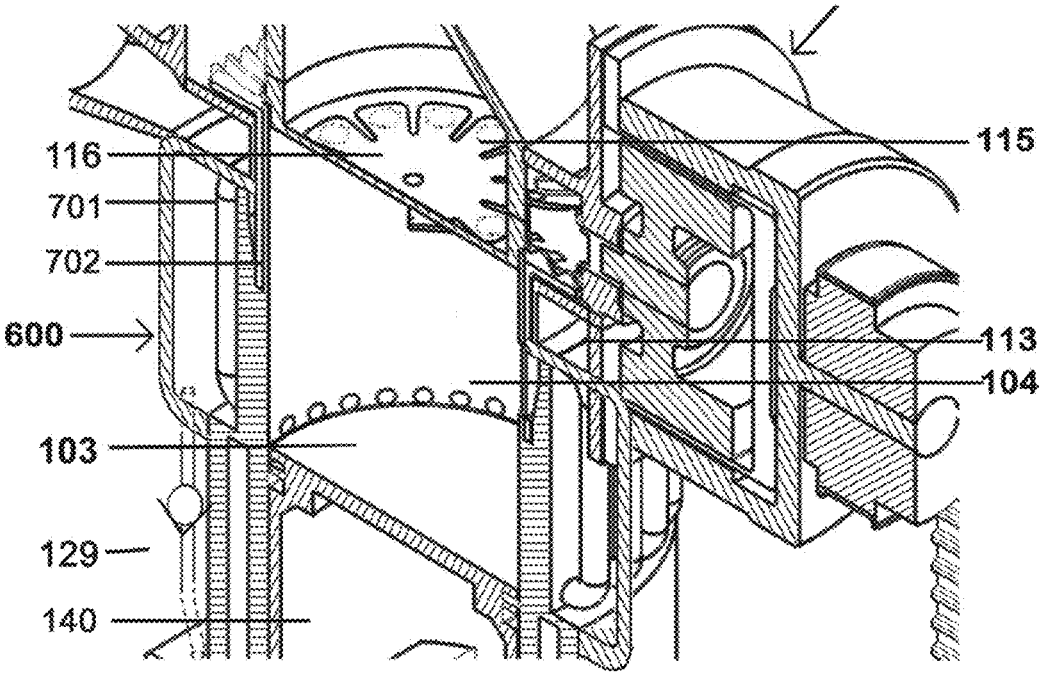
FIG. 16 shows further details of the operation of the valves. Note that the engine piston strokes are divided into the nearly isothermal portions and the near-adiabatic portions. The concept continues to distinguish these two expansion/pump volumes although now those volumes are incorporated in the action of the working piston moving in the working cylinder.

FIG. 16 also shows specifically the TDC valve operation and inner workings of the inlet valve 121 and connection valve 122. Inlet valve 121 is momentarily open at TDC for injecting the bolus. The figure also shows the workings of the valve 122, connecting the cooling reservoir 600 (not in the figure) to the working chamber 104 (not in the figure), opened during almost the entire upstroke. As explained above, both inlet valve 121 and connection valve 122 are mounted on the valve frame 130, having a conical frustum shape as shown in the isometric view and rotating under the gear power train which is driven by the crankshaft 141 connected to belt 800. FIG. 12*a* in this figure shows a detail of port 122 as it rotates on the valve frame 130, opens at BDC and closes immediately before valve port 121 opens at TDC. Note that the body frame 401 (surrounding and sandwiching the valve frame 130) provides a seat for valve frame 130. Note that bevel gear 152 is mounted on the valve frame 130 which is driven by bevel gear 151. To prevent friction between the contacts of the valve frame 130 and the engine body frame 401, at the bottom surface of the valve frame 130, ball bearings 107 are seated to minimize contact between the body 401 and valve frame 130. The ring portion of the valve frame 130 rides on these ball bearings 107. The figure also shows a top view of the inner workings of the inlet valve 121, and the connection valve 122 between the cooling reservoir 600 and working chamber 104 as explained above.

The volumes are defined and distinguished by the sequence of the opening and closing of the inlet 121 and connecting 122 valves. For example, the opening of the inlet valve 121 at the beginning of the downstroke near-isothermally feeds hot working fluid into the opening expansion volume 702. When that inlet valve 121 is closed, the downstroke becomes the near-adiabatic expansion downstroke of the work output during cycle. Likewise, the upstroke is the near-adiabatically compressed portion of the work input as long as the connecting valve 122 between the cooling reservoir and working cylinder is open. When that connecting valve closes, the remaining volume in the working cylinder become the pump volume 700 during the upstroke to TDC and thus defines that pump volume and becomes that pump volume (filled with working fluid) that is pressed near-isothermally back to the high pressure/temperature level of the hot heat exchanger.

Figure 17:
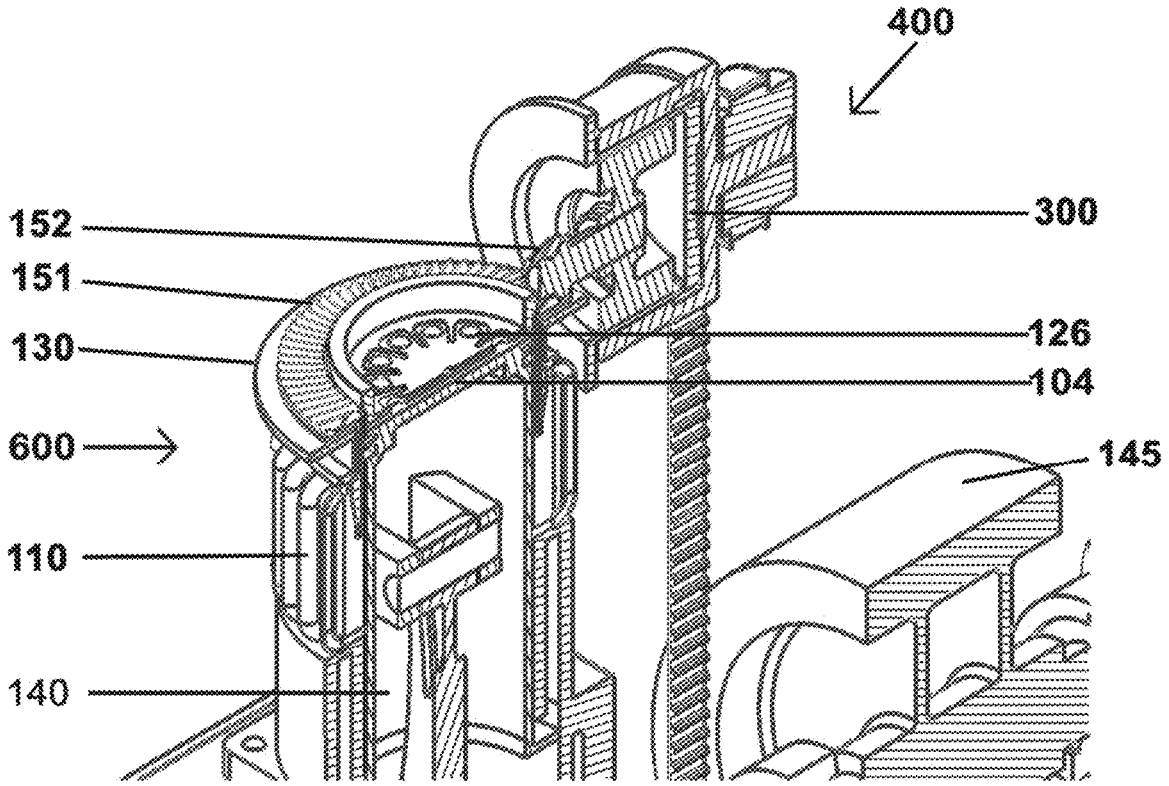
FIG. 17 shows a sectional cut of the engine. As the pump chamber closes, the working fluid will be pushed out of the engine through the check valve and into the hot heat exchanger (not shown in the drawing).

FIG. 17 is a sectional cut of the engine, using a xy axis chamber 701. As the pump chamber 701 closes, the working fluid 703 (not shown in the figure) will be pushed out of the engine 400 through check valve 126 and into the hot heat exchanger 500 (not in the figure). Note that the closed cooling reservoir 600 will contain its high pressure, cooled fluid until reaching BDC for the next BDC release into the working chamber 104, supercooling of the expanded working fluid 703. Additionally, FIG. 13 shows the compact internal configuration of the internal volumes affecting the cycling process of the engine 400. The interior volumes, that contain the working fluid 703 flowing through the cycling system, are compactly configured wherever possible so as to eliminate losses or wasted energy due to residual volumetric pockets of uncycled working fluid. The relevant volumes are designed compacted so as to minimize any dead volumetric pockets that are not being cycled through the engine 400 during the disclosed action. These dead volumes are minimized in order to optimize the thermal to work conversion of the system. All other volumes outside of these four listed volumes are not part of nor are have relevant to the above listed internal volumes that affect the engine efficiency. Since minimizing the residual dead volumetric pockets will significantly improve the cycle efficiency of the engine, the means for achieving this improvement must also be herein included as proprietary disclosures.

Figure 18:
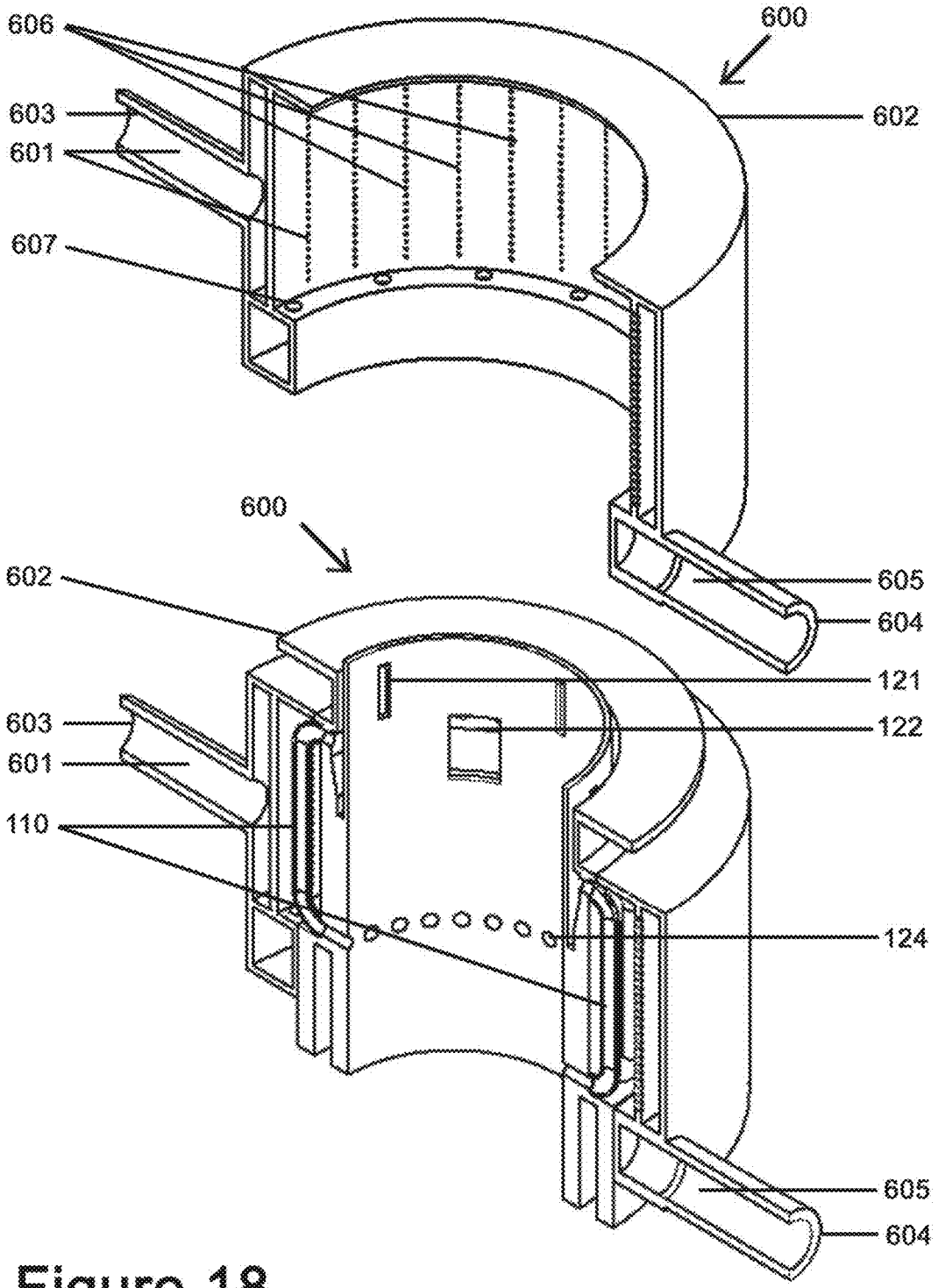
FIG. 18 describes the interior operation of the cooling reservoir. Note that a cool fluid, likely water and ammonia, is sprayed on the cooling coils. The hot coils are rapidly cooled because the cooling fluid being sprayed undergoes a rapid phase change turning into vapor, absorbing a great deal of energy. The expansion caused by producing this vapor will force the hot vapor out of the cooling chamber where it will be recondensed.

FIG. 18 shows the operation of the cooling reservoir 600 wherein a liquid coolant 601 such as cold water or ammonia water is sprayed onto the cooling coils and the phase change is caused through the evaporation of the liquid coolant, which is converted from a liquid into a vapor, causing optimum heat absorption in the cooling process. The coolant 601 enters in an entrance tube into a chamber as a liquid and is sprayed through rows of mini spray nozzles 606 into the cooling reservoir casing 602 directly onto the cooling coils 110. The coolant will vaporize, and the phase change will cause significant heat absorption, drawn from the compressed working fluid 703 in the engine. The expansion of the vapor will rapidly force the vapor out of the cooling reservoir through opening 607 and out outlet tube 604. Note that the pressurize working fluid in the cooling coils 110 passes through the connecting valve 122 and that the cooling period of time is extended while the working fluid 702 is held in containment during the downstroke (expansion stroke) of the cycle.

FIG. 19 shows the shutoff valve 201 between the engine 400 and the containment furnace 900. When the engine powers down and stops, to prevent flooding of the engine 400, a shutoff valve 201 completely shuts off flow through openings 203 between the engine 400 and the containment furnace 900. Instead the shutoff valve 201 redirects the flow so as to open up passage at 202 between the exhaust line and the inlet line to the engine 400, allowing the working fluid in the engine 400 to circulate during startup in order to minimize the internal resistance. The engine 400 is started by the power of the alternator (the generator/starter motor). Once the momentum of the flywheel of the engine builds up, the valve 201 will open up allowing hot working fluid in the hot heat exchanger 500 to flow into and drive the engine 400.

Figure 20:
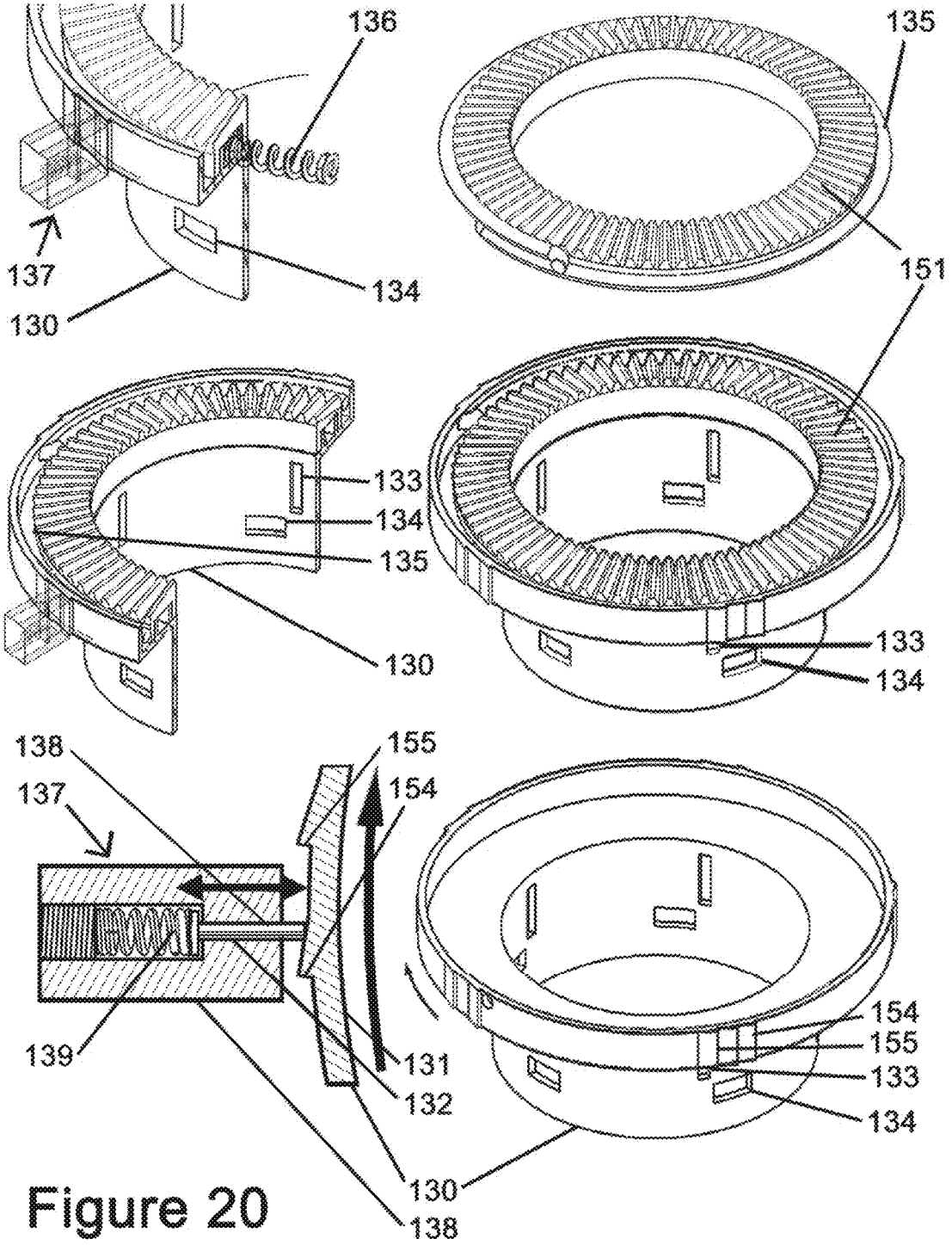
FIG. 20 shows the operation of the valve snap shut mechanism, and how the bevel gear and valve frame swivel on a common axis allowing the valve openings on the valve frame to shift slightly so as to extend the open time of the inlet valve and of the connecting valve, the mechanism being spring biased so that it can snap shut at the appropriate point, optimizing the flow capacity through the valve openings and snapping shut the valves for more precise timing of the flow and of the corresponding filling or connectivity served by the valves.

FIG. 20 shows the operation of the snap shut valve mechanism 140. The large bevel gear 151 around the ring of the valve frame 130 will rotate at a constant speed while the valve frame 130 itself, although spinning on the same central axis, has a torsion spring bias 105 or 136 that allows the valve openings 133 and 134 to be slightly pulled back ensuring the opening is wider and the closing is more deliberate. A torsion spring 135 or 136 allows the valve opening 133 or 134 to be extended to the point of deliberate closing. The valve frame 130 is slightly held back as the biased swivel resister 137 rides over an ramp 154 and 155 obstacle, because the torsion spring 135 or 136 is bias so the valves 133 or 134 are in the open position, will snap shut at the exact point defining the expansion volume 702 and the pump volume 701, optimizing the filling of the expansion volume 702 for optimum volumetric definite for the near-adiabatic expansion, and optimizing the definition of the pump volume 701 for precise pumping of an equal quantity of working fluid 703 as the bolus injected into the expansion chamber 702 of the engine at the beginning of the cycle.

TERMS

1000—the thermal system, called the Gas-Tricity, including the near-adiabatic engine and containment furnace
400—engine
401—engine body frame
402—body frame for the valve frame, having conical frustum shape
500—a heat exchanger
600—a cooling reservoir
601—cooling water
602—cooling reservoir casing
603—inlet tube
604—outlet tube
605—vaporized coolant
606—rows of mini spray nozzles
607—opening to the outlet tube
700—a fluid pump
701—pump chamber
702—expansion chamber
703—working fluid
110—tubes of a cooling chamber
101—output mechanism
121—inlet port
122—port to and from the cooling reservoir
123—engine outlet port
124—BDC port to cooling reservoir
126—check valve between the pump chamber and the heat exchanger
128—flapper plate of valve 126
129—check valve between the crankcase volume 140 and the cooling reservoir volume 600
103—power piston
104—the working chamber
105—power piston bellows
106—connecting rod
107—ball bearings for seat of valve frame for valves 121 and 122, having a conical frustum shape
108—piston rings
100—upstroke compression chamber in the working chamber
800—belt between the crank shaft and valve mechanism
806—valve mechanism pulley
140—crankcase volume
141—crankshaft
142—crankshaft magnetic coupling
143—crankshaft belt pully
144—main crankshaft pully
145—main crankshaft flywheel
130—valve frame
131—valve frame out wall track
132—ramp resister
133—the inlet valve ports on the valve frame
134—the cooling reservoir valve ports on the valve frame
135—torsion spring for valve frame and bevel gear
136—compression spring for valve frame and bevel gear
137—swivel resister spring loaded
138—valve frame mini cam drag resisters
139—drag resister spring
140—the snap shut mechanism
150—bevel and spur gears
151—bevel gear for the valve frame
152—small bevel gear and shaft
900—containment furnace
901—furnace inner exchanger coils
902—furnace outer casing
903—gas facet
904—furnace hot outlet
905—furnace cooler inlet
906—flue outlet
300—magnetic coupling
301—interior shaft of magnetic coupling
302—exterior shaft of magnetic coupling
303—membrane of magnetic coupling
201—shutoff valve between the heat exchanger and the engine
202—loop port
203—connection port

The invention claimed is:

1. A near-adiabatic cycle heat engine, comprising:

a working chamber;

a power piston moveably housed within the working chamber, and configured to run on working fluid fed into said working chamber from a heat exchanger, and perform a pumping action to force said working fluid in and out of said working chamber;

stored rotational energy means connected to said power piston through a connecting rod and a crankshaft, the stored rotational energy means configured to balance forces to fill an expansion chamber and empty a pump chamber with continuous rotational movement;

an inlet valve configured to batch and isolate said working fluid in said working chamber for near-adiabatic expansion;

a cooling reservoir configured to release cooled working fluid to cool said working fluid in said working chamber after a near complete expansion movement of said power piston;

a TDC connecting valve configured to separate a portion of said working fluid from said working chamber and near-isothermally cool said cooled portion of fluid in response to the power piston compressing the portion of said cooled portion of fluid at a near constant low temperature into the cooling reservoir; and a BDC uniflow valve configured to close to contain a compressed cooled portion of fluid in said cooling reservoir, and open to release said compressed cooled portion of fluid into the working chamber in response to said power piston near completion of a sequential expansion downstroke of said power piston, wherein the cooling reservoir is configured to remove heat from said cooled portion of fluid in the working chamber by releasing said cooled portion of fluid in said cooling reservoir into said working chamber, during a compression of said cooled portion of fluid in said working chamber, the power piston is configured to move to separate a total fluid to near-isothermal and near-adiabatic portions according to a ratio differential of respective densities, the near-isothermal portion of said total fluid pressed near-isothermally into the cooling reservoir removing the heat while the near-adiabatic portion of remaining working fluid is pressed near adiabatically directly into said pump chamber, which is an extension of the working chamber, before said pumping action occurs, during said compression of said cooled portion of fluid in said working chamber, in which the portion of said total fluid that is not pressed into the cooling reservoir remains in said working chamber and is near adiabatically pressed directly into the pump chamber before the pumping action occurs, and in response to the nearly isothermal and near-adiabatic portions of the total fluid in the working chamber being compressed, a quantity of the working fluid compressed into the pump chamber is equal to a quantity of the working fluid initially injected into the working chamber at TDC from the heat exchanger at beginning of an engine cycle.

2. The near-adiabatic cycle heat engine of claim 1, the engine cycle achieving a complete and near-adiabatic cycle, wherein the near-adiabatic cycle heat engine is configured to receive said working fluid into said working chamber through the inlet valve, move said power piston to sequentially expand said working fluid in the working chamber and produce positive work, while containing said cooled portion of fluid in the cooling reservoir in compression, and release said cooled portion of fluid from said cooling reservoir through said BDC uniflow valve and through the TDC connecting valve with openings mounted on a valve frame located at near the TDC to cool said working fluid, the BDC uniflow valve and the TDC connecting valve releasing said cooled portion of fluid from said cooling reservoir by exposure due to said power piston at near BDC and removing the heat from said working chamber while said power piston at near said BDC, the BDC uniflow valve is configured to open and close by exposure due to said power piston being at the BDC of said working chamber, said portion of fluid flows through the openings on said TDC connecting valve that is mounted on said valve frame until pumping portion of the upstroke of the power piston begins, thus, the compressed cooled portion of fluid in said cooling reservoir is held in containment, and the pumping action commences, said TDC connecting valve between said cooling reservoir and said working chamber is configured to be open during the compression portion of the upstroke and before said pumping action occurs, said working fluid in said working chamber that is not pressed into the cooling reservoir is compressed into said pump chamber before said pump chamber is fully defined and pumping into the heat exchanger begins, said pump chamber has a pump volume defined as a remaining volume in the working chamber after the TDC connecting valve between the cooling reservoir and said working chamber is closed, to complete the engine cycle at near the TDC, a size of said pump volume is defined coinciding with and at a point of closing of said TDC connecting valve between the cooling reservoir and the working chamber, the power piston is configured to unidirectionally push said working fluid out of the working chamber through a check valve between the pump chamber and the heat exchanger, and a next injection of the working fluid occurs when the power piston is near or at the TDC and said next injection of the working fluid from the heat exchanger is isolated in said working chamber allowing for near adiabatic expansion, said TDC connecting valve, said BDC uniflow valve, said inlet valve and said check valve are tightly configured to minimize residual dead volumetric pockets, the quantity of said working fluid in said pump chamber is equal to the quantity of said working fluid that was initially injected into the expansion chamber or said piston working chamber by balancing a density ratio between said working fluid in the pump chamber and said cooled portion of fluid in the cooling reservoir so as to maximize near-isothermal heat absorption in said cooling reservoir and near-adiabatic compression of the working fluid into said working chamber and pump chamber, said quantity and said density of said working fluid in the pump chamber are controlled by sizing an internal volume of said cooling reservoir;

said cooling reservoir is configured to gain time to contain the working fluid in said cooling reservoir for heat absorption during a time period of the sequential expansion downstroke of the power piston, and heat from cooling coils in the cooling reservoir is removed, but not limited to, by spraying a cold fluid mist on said cooling coils causing a phase change for heat absorption wherein the cold fluid mist includes water, ammonia/water, or refrigerants.

3. The near-adiabatic cycle heat engine of claim 1, wherein the power piston is configured to receive a centrifugal inertia of the stored rotational energy means so that rotational inertia acts on the power piston to unify and smooth out expansion and compression forces and the pressures of the working fluid acting on the power piston, the stored rotational energy means is configured to balance the expansion and compression forces acting on the power piston, and apply the rotational inertia of the stored rotational energy means to pump the working fluid in the pump chamber of the working chamber into the heat exchanger, and the power piston is configured to create positive work during an injection of the working fluid into the working chamber so that the positive work balances against negative work during the pumping action of the power piston as the working fluid is pumped out of the pump chamber and into the heat exchanger, wherein the near-adiabatic engine is configured to:

cycle the working fluid from the heat exchanger into the working chamber, batch said working fluid into the working chamber from the heat exchanger and subsequently isolate said working fluid, expand the working fluid in isolation, remove the heat from said working fluid within the working chamber and store said cooled portion of fluid prior to releasing said cooled portion of fluid to the working chamber, compress the working fluid into the pump chamber in the working chamber near adiabatically before pumping said working fluid back into the heat exchanger for reheating, and cycle the working fluid out of the working chamber into the heat exchanger from a first temperature/pressure level to a second temperature/pressure level higher than the first temperature/pressure level.

4. The near-adiabatic cycle heat engine of claim 1, wherein an expansion volume of the expansion chamber and a pump volume of the pump chamber comprise one united volume in the working chamber;

a residual dead volume of said working fluid being cycled is minimized, minimizing volumetric pocket waste at valve connections of said working chamber, including in said pump chamber, a residual dead volumetric pocket in said inlet valve between said heat exchanger and said working chamber is minimized, a residual dead volumetric pocket in said BDC uniflow valve between said cooling reservoir and said working chamber is minimized, a residual dead volumetric pocket in said TDC connecting valve between the cooling reservoir and said working chamber is minimized, a residual dead volumetric pocket in a check valve between the pump chamber and the heat exchanger is minimized, and a residual dead volumetric pocket in the inlet valve and mechanism of a valve frame are minimized.

5. The near-adiabatic cycle heat engine of claim 1, wherein a point of having filled the expansion chamber coincides with a point of closing of the inlet valve, a point of the pump chamber being fully defined coincides with a point of closing of the TDC connecting valve between the cooling reservoir and the working chamber, the TDC connecting valve between said working chamber and said cooling reservoir is mounted on a valve frame, said inlet valve between said heat exchanger and said working chamber is mounted on said valve frame, the expansion chamber and the pump chamber are connected to have one common volume in the working chamber as defined by a movement of the power piston within the working chamber in relationship to the opening and closing of said TDC connecting valve, the pressure of the working fluid in said pump chamber during said pumping action rises with a compression action of the power piston during said pumping action, forcing open a check valve between said pump chamber and the heat exchanger, said check valve between the expansion chamber and the heat exchanger is configured to remain closed during the filling into the expansion chamber with said working fluid from said heat exchanger, a flapper plate reed valve is configured to allow a unidirectional flow of said working fluid from the pump chamber to said heat exchanger, said flapper plate reed valve between the pump chamber and said heat exchanger has a plurality of openings, the inlet valve between said heat exchanger and said expansion chamber has multi-inlet openings to allow flow of said working fluid, the TDC connecting valve between the working chamber and the cooling reservoir has a plurality of openings, and the BDC uniflow valve at BDC have a plurality of openings.

6. The near-adiabatic cycle heat engine of claim 1, wherein a separation between first and second pressures is maintained by sequential operation of the TDC connecting valve, said inlet valve, and a check valve in the working chamber at the pump chamber, the unidirectional flow is caused by the sequential operation of closing of the TDC connecting valve between the said working chamber and said cooling reservoir, and the maintained closing of the inlet valve between said heat exchanger and said working chamber, and the opening of said check valve between said pump chamber in said working chamber and said heat exchanger, the sequential operation occurs in response to said power piston approaching near the TDC such that the TDC connecting valve between said cooling reservoir and said working chamber closes defining said pump volume and a movement towards approaching near the TDC becomes the pumping action of said power piston, when said TDC connecting valve between said cooling reservoir and said working chamber closes, working near-adiabatic compression upstroke in the working chamber ends and piston action in the working chamber becomes said pumping action on said pump chamber, pumping the working fluid out of the pump chamber and into the heat exchanger, coinciding with the pumping action, an expansion volume of the expansion chamber is an extension of the working chamber, a pump volume of the pump chamber is an extension of the working chamber, and the inlet valve supplying said working fluid from the heat exchanger to the working chamber does not open until the engine cycle nearly reaches or reaches the TDC.

7. The near-adiabatic cycle heat engine of claim 1, further comprising a valve frame, wherein the valve frame is ring-shaped, the inlet valve on the valve frame is configured to open at the TDC, allowing said working fluid from said heat exchanger into said working chamber, an operation of said valve frame is connected to the crankshaft and is synchronized to achieve predetermined timing and flow/action sequence of the inlet and TDC connecting valves, a movement of said valve frame is minimized while openings of said inlet and TDC connecting valves are maximized, allowing maximum fluid flow into and within the working chamber, said valve frame is saddled on or in a wall of the working chamber, opening in said wall of the working chamber cylinder provide openings for the TDC connecting valve between said cooling reservoir and said working chamber, said inlet valve between said heat exchanger and said expansion chamber on said valve frame has multi-openings, minimizing the valve movement while allowing fluid flow, said TDC connecting valve between the cooling reservoir and the working chamber has multi-openings and remains open during the negative work portion of the compression upstroke, the TDC connecting valve between said cooling reservoir and said working chamber closes coinciding with a point of defining a pump volume of the pump chamber, the working fluid in the pump chamber is pumped out through a check valve into said heat exchanger, friction between said valve frame and a casing of an engine body is minimized by placing ball bearings between said engine body and said valve frame, and said ball bearings are placed on multi-surfaces of said valve frame.

8. The near-adiabatic cycle heat engine of claim 1, wherein valve openings on a valve frame are configured to allow for snap closing of said inlet and TDC connecting valves, a swivel mechanism between a driving bevel gear and the valve frame is configured to allow said valve frame of said inlet valve and TDC connecting valve between the working chamber and cooling reservoir to pivot on a swivel axis located in a center of the driving bevel gear and the valve frame that connects and rotates the valve frame in tandem with the TDC connecting valve, said swivel mechanism is loaded with biasing means including a hinge end torsion spring or compression spring mounted between the driving bevel gear and said valve frame to allow the snap closing of the inlet and TDC connecting valves, said swivel mechanism is spring loaded during a rotation of the valve frame at closing action to snap shut the inlet valve and TDC connecting valve, and said spring loaded swivel mechanism is configured to ride over ramp obstacles so as to load a biased condition, impeding the closing action, allowing the valve frame to move into a biased position and snap shut when the TDC connecting valve and inlet valve require closing at a point of defining sequential expansion volume and pump volume of the engine cycle.

9. The near-adiabatic cycle heat engine of claim 1, wherein a volume inside said cooling reservoir is sized to accommodate nearly isothermal absorption during compression upstroke so as to accommodate adiabatic compression of said working fluid into said pump chamber that nearly matches adiabatic compression conditions, the volume inside said cooling reservoir is sized so as to achieve near-adiabatic compression in the pump chamber during said compression of said working fluid in the working chamber at said pump chamber to cause the quantity of working fluid that is being pressed into said pump chamber to be equal to the quantity of working fluid initially injected at the TDC into said expansion chamber from said heat exchanger, the quantity of working fluid in said pump chamber is made equal to the quantity of working fluid in said expansion chamber by balancing a density ratio between said cooling reservoir and said pump chamber so to achieve the heat absorption in said cooling reservoir, and by sizing the volume of said cooling reservoir, a predetermined quantity of near-adiabatic compressed working fluid is pressed into said pump chamber equaling the quantity of said working fluid initially injected at a beginning of the engine cycle, the quantity of working fluid in said pump chamber is determined by a point of closing of the TDC connecting valve between the working chamber and said cooling reservoir, said cooling reservoir is located around an outside parameter of said working chamber so as to integrate and provide fluid access and flow between said cooling reservoir and said working chamber for heat removal, the cooled working fluid from said cooling reservoir to said working chamber is released by the synchronized opening of said BDC uniflow valve due to a movement of said power piston at BDC and the simultaneous opening near the TDC of said TDC connecting valve between said cooling reservoir and said working chamber, a heat transfer barrier is located between the wall of the said working chamber and the cooling reservoir, and cooling coils or elements of the cooling reservoir are cooled by spraying a mist of liquid coolant on said cooling coils causing a phase change by evaporation of the liquid coolant, converting the liquid into vapor, and causing heat absorption during cooling process.

10. The near-adiabatic cycle heat engine of claim 1, further comprising:

a first magnetic coupling configured to seal the crankshaft between an interior bevel gear connection mounted on a valve frame and outside atmosphere, for preventing leakage;

a second magnetic coupling configured to connect a torque of a bevel gear mechanism that actuates said valve frame to a timing pulley and timing belt outside the heat engine;

a third magnetic coupling configured to seal the crankshaft from leakage to the outside atmosphere while transferring engine power, and provide a torque connection from an interior power output of the heat engine to an exterior power output, wherein connection means along a power train between the crankshaft and the valve frame that is inside the heat engine includes a gear or mechanical connecting means other than the timing belt.

11. The near-adiabatic cycle heat engine of claim 1, further comprising:

a ceramic casing or wall configured to provide heat containment in said working chamber so as to minimize the heat absorption through the ceramic wall during operation; and a ceramic material containing the heat in said working chamber, and a pump encasement so as to minimize heat transfer through the ceramic wall.

12. The near-adiabatic cycle heat engine of claim 1, further comprising:

a shutoff valve configured to prevent flow of working fluid from said heat exchanger to said heat engine, for preventing an equalization of pressures in said heat engine when idle and preventing flooding of said heat engine;

a bridge valve configured to gradually open as said heat engine establishes predetermined pressure/temperature separation; and valve means wherein when a shutoff occurs between the said heat exchanger and said heat engine, another opening allows flow from a heat engine exhaust to an engine intake, so that the working fluid inside the heat engine can freely flow in a loop, minimizing internal resistance during startup.

13. The near-adiabatic cycle heat engine of claim 1, wherein during an engine startup, said power piston, acting in said working chamber, is configured to be driven by an alternator motor/generator, converting said heat engine into a circulation pump that drives leaked working fluid in said heat engine back out into said heat exchanger before transitioning from a startup pumping mode to a running power output mode, and a single cylinder engine with the stored rotational energy means configured to be started by using the alternator motor/generator to build up rotational momentum before heat from the heat exchanger is fed into the heat engine.

14. The near-adiabatic cycle heat engine of claim 1, further comprising:

solenoid actuating mechanisms controlled by sensors configured to actuate a main shut off valve between said heat exchanger and said heat engine or a bridge valve between said working chamber and said pump chamber.

15. The near-adiabatic cycle heat engine of claim 1, further comprising:

a series of gears configured to transfer and interconnect action between the crankshaft and a valve frame;

a timing belt or belts configured to connect the crankshaft and said valve frame; and connection means located inside a body of the heat engine to avoid leakage.

16. A system, comprising:

the near-adiabatic cycle heat engine of claim 1; and a containment furnace configured to produce and contain a furnace heat to drive the heat engine, wherein the furnace heat is produced by burning fuel through a facet fuel burner, an outer shell of the containment furnace is made of a heat containing material including ceramic shell, inside the containment furnace, the heat produced from the facet fuel burner is transferred to the working fluid through said heat exchanger that stretches a length of the containment furnace, the containment furnace is linear, worm, or spiral shaped to contain internal heat or optimize the transfer of the internal heat from the heat exchanger to the heat engine, and to conform to an interior space and requirements of an appliance encasement, the containment furnace is configured to exhaust fumes through an exit flue before passing the heat through a water heater and/or HVAC unit for preheating, temperature sensors are configured to maintain a predetermined flowrate through said containment furnace by monitoring an operation of said containment furnace and associated appliances for predetermined temperature and heat utilization and/or heat to work conversion between the associated all its appliances, an internal fan is configured to contain and draw off the heat from the containment furnace to maintain the predetermined flowrate, said containment furnace, said heat engine and a generator are configured to interphase with a central heater, water heater, AC, and absorption chiller to achieve predetermined heat utilization, the temperature sensors are attached to the facet fuel burner of the containment furnace to regulate the predetermined heat utilization.

17. The near-adiabatic cycle heat engine of claim 1, wherein the power piston is configured to oscillate as a floating piston, with a linear electricity generator means that oscillates as a floating piston.

18. The near-adiabatic cycle heat engine of claim 1, further comprising:

a plurality of power pistons and a plurality of working cylinders configured to accommodate a plurality of applications.

19. The near-adiabatic cycle heat engine of claim 1, wherein the working fluid for the heat engine includes helium, hydrogen, carbon dioxide, or air.

20. A near-adiabatic cycle heat engine, comprising:

a working chamber;

a power piston moveably housed within the working chamber, and configured to run on working fluid fed into said working chamber from a heat exchanger, and perform a pumping action to force said working fluid in and out of said working chamber;

a flywheel connected to said power piston through a connecting rod and a crankshaft, the flywheel configured to balance forces to fill an expansion chamber and empty a pump chamber with continuous rotational movement;

an inlet valve configured to batch and isolate said working fluid in said working chamber for near-adiabatic expansion;

a cooling reservoir configured to release cooled working fluid to cool said working fluid in said working chamber after a near complete expansion movement of said power piston;

a TDC connecting valve configured to separate a portion of said working fluid from said working chamber and near-isothermally cool said cooled portion of fluid in response to the power piston compressing the portion of said cooled portion of fluid at a near constant low temperature into the cooling reservoir; and a BDC uniflow valve configured to close to contain compressed cooled portion of fluid in said cooling reservoir, and open to release said compressed cooled portion of fluid into the working chamber in response to said power piston near completion of a sequential expansion downstroke of said power piston, wherein the cooling reservoir is configured to remove heat from said cooled portion of fluid in the working chamber by releasing said cooled portion of fluid in said cooling reservoir into said working chamber, during a compression of said cooled portion of fluid in said working chamber, the power piston is configured to move to separate said total fluid to near-isothermal and near-adiabatic portions according to a ratio differential of respective densities, the near-isothermal portion of said total fluid pressed near-isothermally into the cooling reservoir removing the heat while the near-adiabatic portion of said remaining working fluid is pressed near adiabatically directly into said pump chamber, which is an extension of the working chamber, before said pumping action occurs, during said compression of said cooled portion of fluid in said working chamber, in which the portion of said total fluid that is not pressed into the cooling reservoir remains in said working chamber and is near adiabatically pressed directly into the pump chamber before the pumping action occurs, and in response to the nearly isothermal and near-adiabatic portions of the total fluid in the working chamber being compressed, a quantity of the working fluid compressed into the pump chamber is equal to a quantity of the working fluid initially injected into the working chamber at TDC from the heat exchanger at beginning of an engine cycle.

* * * * *